US011703235B2

(12) United States Patent
Murakami

(10) Patent No.: US 11,703,235 B2
(45) Date of Patent: Jul. 18, 2023

(54) EXTERNAL-AIR CONDITIONING APPARATUS AND VENTILATION SYSTEM

(71) Applicant: Eco Factory Co., Ltd., Kumamoto (JP)

(72) Inventor: Takanobu Murakami, Kumamoto (JP)

(73) Assignee: Eco Factory Co., Ltd., Kumamoto (JP)

( * ) Notice: Subject to any disclaimer, the term of this patent is extended or adjusted under 35 U.S.C. 154(b) by 785 days.

(21) Appl. No.: 16/496,402

(22) PCT Filed: Oct. 16, 2018

(86) PCT No.: PCT/JP2018/038424

§ 371 (c)(1),
(2) Date: Sep. 20, 2019

(87) PCT Pub. No.: WO2019/202757

PCT Pub. Date: Oct. 24, 2019

(65) Prior Publication Data

US 2021/0404673 A1 Dec. 30, 2021

(30) Foreign Application Priority Data

Apr. 19, 2018 (JP) ..... 2018-080699

(51) Int. Cl.
*F24F 1/36* (2011.01)
*F24F 1/56* (2011.01)
(Continued)

(52) U.S. Cl.
CPC ..... *F24F 1/36* (2013.01); *F24F 1/18* (2013.01); *F24F 1/56* (2013.01); *F24F 7/003* (2021.01);
(Continued)

(58) Field of Classification Search
CPC ..... F24F 1/36; F24F 13/20; F24F 1/56; F24F 13/222; F24F 13/22; F24F 1/00;
(Continued)

(56) References Cited

U.S. PATENT DOCUMENTS

2015/0338108 A1* 11/2015 Murakami ..... F24D 3/16 165/49
2019/0203953 A1* 7/2019 Hara ..... F24F 13/222

FOREIGN PATENT DOCUMENTS

CN 106133451 A * 11/2016 ..... F24F 1/02
JP 1973-110452 9/1973
(Continued)

*Primary Examiner* — Frantz F Jules
*Assistant Examiner* — Martha Tadesse
(74) *Attorney, Agent, or Firm* — Heedong Chae; Lucem, PC

(57) ABSTRACT

An external-air conditioning apparatus and a ventilation system are provided, the external-air conditioning apparatus includes a fin tube type heat exchanger and a housing that stores this heat exchanger. The housing includes a base body that serves as a back side of the apparatus body and a cover body that serves as a front side of the apparatus body, and the base body and the cover body are dividable and detachable in structure. The base body has a base portion, a partitioning portion, a connecting pipe portion, a heat-exchanger-holding structure portion, and a water receiving portion. The cover body is a structure in which a front wall portion and a three-side peripheral wall portion are formed integrally with each other, and a part in which the peripheral wall portion is not formed is an inlet for external air.

17 Claims, 15 Drawing Sheets

(51) Int. Cl.

| | |
|---|---|
| ***F24F 1/18*** | (2011.01) |
| ***F24F 13/20*** | (2006.01) |
| ***F24F 13/22*** | (2006.01) |
| ***F24F 7/003*** | (2021.01) |

(52) U.S. Cl.
CPC ..... *F24F 13/20* (2013.01); *F24F 13/222* (2013.01); *F24F 2013/227* (2013.01)

(58) Field of Classification Search
CPC ..... F24F 2013/227; F24F 13/30; F24F 1/48; F24F 1/0057
See application file for complete search history.

(56) References Cited

FOREIGN PATENT DOCUMENTS

| | | | | | |
|---|---|---|---|---|---|
| JP | 62-52338 | A | | 3/1987 | |
| JP | 3-45837 | A | | 2/1991 | |
| JP | 04-174227 | A | | 6/1992 | |
| JP | 05126353 | | * | 5/1993 | |
| JP | H05126353 | A | * | 5/1993 | ..... H04J 3/0685 |
| JP | 2003-329267 | A | | 11/2003 | |
| JP | 2006-189241 | A | | 7/2006 | |
| JP | 4294784 | B2 | | 7/2009 | |
| JP | 6284134 | B1 | | 2/2018 | |
| WO | 2017009951 | A1 | | 1/2017 | |

* cited by examiner

-- PRIOR ART --

EXTERNAL-AIR CONDITIONING APPARATUS AND VENTILATION SYSTEM

TECHNICAL FIELD

The present invention relates to an external-air conditioning apparatus and a ventilation system. More particularly, the present invention relates to an external-air conditioning apparatus and a ventilation system that are capable of being easily installed in housing complexes or ordinary houses (hereinafter, referred to as "housing complexes, etc."), that are capable of being easily installed in new or already-existing housing complexes, etc., that are capable of having excellent workability in cleaning or maintenance (hereinafter, referred to as "maintenance etc.," and that are capable of reducing the operation load of an air conditioning apparatus (hereinafter, referred to as a "room air conditioner") whose indoor unit is installed on the indoor side.

BACKGROUND ART

Conventionally, there has been equipment provided with an external-air conditioning apparatus to reduce a temperature difference between external air to be introduced and room air at a place between both ends of an introducing passage through which external air is admitted into a room. For example, air conditioning equipment shown in Patent Literature 1 below has been proposed as the thus formed equipment, and this equipment is shown in FIG. 15.

An air conditioning equipment 9 shown in FIG. 15 has an external-air conditioning apparatus 91 that is installed outdoors and that processes external air OA and a sensible heat exchanger 93 that is installed near a return air intake 92 to recover air RA supplied into a room R through the external-air conditioning apparatus 91. Herein, the sensible heat exchanger 93 makes a heat exchange with respect to air RA that has been recovered and supplies air SA that has undergone a heat exchange from an air inlet to the room R, and the external-air conditioning apparatus 91 includes a cooling coil 911, a heating coil 912, a humidifier 913, and a blower 914, and sends the external air OA that has been introduced toward the room-R side while thermoregulating and humidifying the external air OA.

CITATION LIST

Patent Literatures

Patent Literature 1: Japanese Patent No. 4294784

SUMMARY OF INVENTION

Technical Problem

In many cases, the external-air conditioning apparatus 91 of the aforementioned air conditioning equipment 9 is generally installed in the ceiling on the roof side (outdoors on the ceiling side) so that the apparatus body does not act as an obstacle (see paragraph [0019] and FIG. 2 of Patent Literature 1), and, in this case, it is difficult to easily perform maintenance, etc.

Additionally, in recent years, a 24-hour ventilation system has been obliged to be installed also in ordinary houses, and, particularly in housing complexes, such as condominiums, it is difficult to realize the house-to-house installation of large-scale equipment, such as the air conditioning equipment 9, because of the problem of an underfloor space or a ceiling space. Still additionally, it is also difficult to install large-scale equipment, such as the air conditioning equipment 9, in an already-existing house later.

Many simple ventilation units or the like in which, for example, a ventilation hole is bored in the outer wall of a veranda or the like and is blocked up with a lid that prevents insects or the like from invading through the hole are seen as ventilation means in housing complexes, etc. However, in this ventilation means, external air is introduced into a room without changing its temperature, and therefore, when the room air conditioner is operated to perform the air-conditioning of the room, the operation load of the room air conditioner becomes large at rise time.

Solution to the Problem

The present invention has been made in consideration of the aforementioned circumstances, and aims to provide an external-air conditioning apparatus and a ventilation system that are capable of being more easily installed in new or already-existing housing complexes, etc., that are capable of having excellent workability in maintenance, etc., and that are capable of making the operation load of a room air conditioner smaller than conventional apparatuses.

An object of the present invention is to provide an external-air conditioning apparatus, the external-air conditioning apparatus including a fin tube type heat exchanger that is incorporatable into a heat medium circuit of an air conditioning apparatus disposed outside the external-air conditioning apparatus and a housing, and the housing includes a base portion in which the heat exchanger is stored and that has an outlet formed at a predetermined position, a front wall portion that is disposed so as to face the base portion and that includes a first insulation structure portion, a peripheral wall portion that is disposed between the front wall portion and the base portion and that includes a second insulation structure portion in which an inlet capable of introducing external air is formed at a position distant from the outlet, a heat-exchanger-holding structure portion in which the heat exchanger is attached in such a way that a longitudinal direction of a fin of the heat exchanger and a direction from the inlet toward the outlet substantially coincide with each other and in which the heat exchanger is held so as to have a predetermined interval between the heat exchanger and an inner surface of the front wall portion, between the heat exchanger and an inner surface of the base portion, and between the heat exchanger and an inner surface of the peripheral wall portion, and a water receiving portion disposed between the heat exchanger and the inlet.

Herein, the external-air conditioning apparatus of the present invention is capable of incorporating the heat exchanger into a heat medium circuit of a room air conditioner (the heat medium includes, for example, a refrigerant, such as freon gas or alternative gas, warm water or cold water, gas for heating or cooling, and so forth; the same applies hereinafter). The heat exchanger incorporated into the heat medium circuit of the room air conditioner is capable of heating or cooling external air introduced into the apparatus by means of a heat medium supplied in conjunction with the running of the room air conditioner while making a heat exchange between the introduced air and the heat medium, and is capable of conditioning (hereinafter, referred to as "thermoregulating") air that has undergone a heat exchange so as to reach a temperature according to an operational purpose of the room air conditioner (according to heating or cooling) (hereinafter, thermoregulated air is referred to as "conditioned air").

The heat exchange performed by the heat exchanger uses a heat medium supplied from the room air conditioner, and influences the running of the room air conditioner, and therefore a temperature difference between an aimed temperature of the room air conditioner and a room temperature by means of conditioned air that has been supplied is made smaller in a region (room) in which the indoor unit of the room air conditioner is installed. As a result, the operating time (hereinafter, referred to as "rise time of the room air conditioner") of the room air conditioner to reach an aimed temperature (preset) becomes short without requiring a longer time. Therefore, the reduced operating time makes it possible to reduce the operation load of the room air conditioner.

Additionally, the heat exchanger interacts with the running of the room air conditioner as described above, and therefore the heat exchanger itself is a structure that does not use electric power, and it is possible to contribute to energy saving by means of the thus formed structure and by means of a reduction in the rise time of the aforementioned room air conditioner.

Additionally, in the external-air conditioning apparatus of the present invention, the heat exchanger is a fin tube type, which is small and light and which is excellent in heat exchange efficiency, and therefore it is possible to make the entirety of the apparatus body of the external-air conditioning apparatus small in size and light in weight. As a result, for example, when the apparatus is set on a wall surface of a building, it is possible to reduce a load from the apparatus that is applied onto the wall surface.

Additionally, the base portion of the housing makes it possible to set the external-air conditioning apparatus of the present invention on an object (for example, wall surface of a building) on which the apparatus is to be set. Additionally, the outlet of the base portion makes it possible to guide conditioned air outwardly. Additionally, it is possible to allow the outlet to lead to the ventilating hole by positionally adjusting the outlet to the ventilating hole formed in an object on which the apparatus is to be set. A position on the upper side of the base portion in an installed state can be mentioned as an example of the "predetermined position" at which the outlet is formed, and yet the present invention is not limited to this.

Additionally, in the external-air conditioning apparatus of the present invention, the housing has the front wall portion and the peripheral wall portion, and, as a result, the heat exchanger, etc. are surrounded (stored) by these portions, and therefore it is possible to prevent the heat exchanger, etc. from being deformed by an external force or from undergoing dirt adhesion. Additionally, it is possible to improve weather resistance and is possible to lengthen the life of a product. Additionally, the inside and outside of the apparatus body are partitioned by the front wall portion and the peripheral wall portion, and therefore it is possible to prevent conditioned air from being mixed with air existing outside the apparatus that has not yet undergone a heat exchange or prevent conditioned air from diffusing outside the apparatus.

Still additionally, it is possible to introduce external air from the inlet by providing the inlet at the peripheral wall portion. Additionally, the inlet is formed at a position distant from the outlet, and therefore it is possible to restrain external air that has entered through the inlet from flowing out directly from the outlet almost without undergoing a heat exchange.

Additionally, the external-air conditioning apparatus of the present invention is capable of reducing a thermal influence from outside the apparatus when external air undergoes a heat exchange by allowing the housing to have the first insulation structure portion and the second insulation structure portion. Even if the outer surfaces of the front wall portion, etc. become high in temperature because of direct sunlight at a summer season or even if the outer surfaces of the front wall portion, etc. become low in temperature because of a snowstorm or the like at a winter season, it is possible to create a state in which such heat is not transmitted directly to the inside of the apparatus (for example, to the inner surfaces of the front wall portion, etc.) or is not easily transmitted thereto, for example, when the external-air conditioning apparatus is installed outdoors. This makes it possible to restrain conditioned air from receiving a thermal influence caused by an environment existing outside the apparatus.

Additionally, the external-air conditioning apparatus of the present invention is capable of holding the heat exchanger so that the heat exchanger does not come into contact with the inner surface of the front wall portion, the inner surface of the base portion, and the inner surface of the peripheral wall portion by having the heat-exchanger-holding structure portion, and is capable of creating a state in which a thermal transfer from the front wall portion, etc. does not directly reach the heat exchanger or does not easily reach the heat exchanger. Additionally, the longitudinal direction of the fin of the heat exchanger that is held and the direction from the inlet toward the outlet substantially coincide with each other, and therefore external air that has entered through the inlet flows along the longitudinal direction of the fin, and flows out from the outlet. As a result, a period of contact time between the external air and the fin is lengthened, and it is possible to improve heat exchange efficiency.

Still additionally, the external-air conditioning apparatus of the present invention has the water receiving portion, and hence can receive dew condensation water generated from the heat exchanger when refrigerated air conditioning is performed. For example, the external-air conditioning apparatus is installed in a state in which the inlet is directed downwardly, and, as a result, the position of the heat exchanger becomes upwardly higher than the inlet, and it is possible to receive dew condensation water that is generated in the heat exchanger and is then allowed to drop by means of the water receiving portion disposed between the inlet and the heat exchanger. This makes it possible to restrain the lower part of the external-air conditioning apparatus from being made dirty with the dew condensation water without allowing the dew condensation water to directly drop downwardly from the inlet. Additionally, if the external-air conditioning apparatus is installed in a state in which the inlet is directed downwardly, dew drops generated on the front surface of the fin are dropped along the fin because the water receiving portion is placed on an extension in the longitudinal direction of the fin of the heat exchanger, and therefore it is possible to efficiently gather dew condensation water.

Additionally, the water receiving portion is positioned between the heat exchanger and the inlet, and therefore, for example, when it is rainy weather with strong wind, rainwater engulfed together with external air from the inlet strikes the water receiving portion, and is then repelled, and therefore it is possible for rainwater not to easily adhere directly to the heat exchanger.

Additionally, if a frame-shaped partitioning portion that partitions a space into an inner space and an outer space is provided between the heat exchanger and the base portion, and if the outlet is positioned in a region within the frame of the partitioning portion, and if a space having a predetermined width is created, external air that has entered the inside the apparatus will not directly reach an exhaust port without passing through the heat exchanger because of the aforementioned partitioning portion, i.e., in other words, it is possible to allow substantially the whole amount of external air that has entered the inside of the apparatus to pass through the heat exchanger.

Additionally, the aforementioned partitioning portion further partitions the inside of the housing into an inner space and an outer space, and therefore it is possible for conditioned air (air that has undergone a heat exchange) not to diffuse in the housing. This makes it possible for substantially the whole amount of conditioned air to pass through the outlet. Therefore, for example, conditioned air is supplied into the room through the ventilating hole that leads to the outlet, and, as a result, the amount of heat loss in the housing decreases, and the amount of conditioned air supplied into the room increases. This makes it possible to shorten a period of time during which a difference between the room temperature and the preset temperature of the room air conditioner becomes smaller and also makes it possible to shorten the rise time of the room air conditioner, and therefore it is possible to further raise the effect of reducing the operation load of the room air conditioner.

Additionally, the housing is a structure dividable into a base body in which the base portion, the heat-exchanger-holding structure portion, and the water receiving portion are disposed and a cover body in which the front wall portion, the peripheral wall portion, and the insulation structure portion are disposed, and, if the base body and the cover body are configured to be attachable to and detachable from each other, what is required is merely to set the base body on the wall surface first and then attach the cover body thereto because the base body and the cover body are dividable from each other, and therefore workability is excellent when installed.

Additionally, after the completion of the installation, disassembly maintenance, such as cleaning of the heat exchanger or of the water receiving portion, can be easily performed merely by detaching the cover body (the base body remains being attached to the wall surface) because the base body and the cover body are attachable to and detachable from each other. In other words, workability in maintenance, etc. is made higher than the conventional external-air conditioning apparatus. It is possible to make the apparatus comparatively light by employing a structure in which only the front wall portion, the peripheral wall portion, and the insulation structure portion are disposed at the cover body, and therefore it is possible to reduce a physical burden required in the detaching operation.

On the other hand, the base body is configured to dispose the base portion, etc., and additionally attach the heat exchanger to the heat-exchanger-holding structure portion, and therefore the base body is comparatively heavy in weight, and yet a detaching operation is not required in maintenance, and work can be started only by detaching the cover body, and components that require maintenance are disposed in a centered state, and therefore it is possible to shorten working hours and to reduce the burden of a worker.

Additionally, it is possible to further improve heat insulation properties of the housing if the front wall portion including the first insulation structure portion and the peripheral wall portion including the second insulation structure portion are structures each of which has an outer surface plate, an inner surface plate capable of reflecting heat that is disposed with a predetermined interval so as to generate a void between the outer surface plate and the inner surface plate, and a heat insulating material disposed so that a thermal insulation region that is a gap with a predetermined interval is formed between the outer surface plate and the heat insulating material in the void.

Ordinarily, the outer surface plate (particularly, metallic plate) struck by direct sunlight becomes high in temperature, and is easily deteriorated by heat if a heat insulating material is, for example, directly pasted thereon. However, in the present invention, an air layer between the outer surface plate and the heat insulating material serves as a thermal insulation region, and fulfills the heat insulating effect, and the heat insulating material is not, for example, directly pasted on the outer surface plate, and therefore it is possible to create a state in which deterioration is not easily caused by a direct heat transfer from the outer surface plate. Additionally, the inner surface plate makes a thermal reflex, and therefore heat emitted from the heat exchanger reflects without being thermally transmitted to the front wall portion and the peripheral wall portion, and heat moves to air existing in the housing that has not yet passed through the heat exchanger, and therefore it is possible to further improve the efficiency of a heat exchange.

Additionally, the heat insulating material is covered with the outer surface plate and the inner surface plate, and, as a result, it is possible to restrain deterioration caused by being directly exposed to sunlight or to wind and rain, and it is possible to restrain deterioration caused by, for example, the adhesion of dew drops generated inside the apparatus and the occurrence of mold on the front surface. Hence, conditioned air introduced into the room is not contaminated by mold, dust, etc., that have adhered to the heat insulating material.

Additionally, if a cylindrical connecting pipe portion formed along a rim of the outlet is provided on an outer surface of the base portion, it is possible to perform positioning only by fitting the connecting pipe portion to the ventilating hole or the like when the cylindrical connecting pipe portion is attached to an object on which the apparatus is to be set (for example, wall surface of a building in which a ventilating hole is bored), and therefore it is possible to raise the efficiency of a laying operation. Additionally, the connecting pipe portion is capable of supporting part of weight in the direction of a gravitational force applied onto the wall surface on which the apparatus has been set by being fitted to the ventilating hole or the like, and therefore it is possible to reduce a load applied onto the wall surface to which the connecting pipe portion has been attached. The size of the ventilating hole is predetermined by a standard, and therefore it is sufficient to prepare several types of connecting pipe portions according to the standard.

Additionally, if the water receiving portion is a structure that includes a water-receiving support portion disposed at the base portion, a drain pan that is detachably supported by the water-receiving support portion, that is open toward the heat exchanger in an open region, that is equal in width to or is larger in width than an end surface of the heat exchanger faced by the open region, and that is formed so as to gradually become smaller in width in proportion to an approach to a bottom, a drain passage capable of draining accumulated water that has been accumulated in the drain pan outwardly from the apparatus, and a heat insulating material for drain pans that is disposed at an outer surface of the drain pan, dew condensation water accumulated in the water receiving portion is naturally drained outwardly from the apparatus through the drain passage, and therefore it is possible to keep the inside of the apparatus sanitary, and short-term maintenance for the purpose of only drainage becomes needless.

It is possible to configure the water receiving portion while supporting the drain pan by having the aforementioned water-receiving support portion. Additionally, for example, if the base body and the cover body are dividable from each other, it is possible to reduce the weight of the cover body by providing the water-receiving support portion at the base portion, and it is possible to reduce a work burden required to attach or detach the cover body when the apparatus is installed or when maintenance is performed.

Notably, if a rectangular-box-shaped drain pan that has a broad, flat bottom surface is applied to the present invention, there is a case in which external air that has entered through the inlet strikes the bottom surface, and, for example, a turbulent flow occurs, and therefore a smooth flow of external air is obstructed. However, the drain pan used in the present invention is formed in a shape in which its width gradually becomes narrower in proportion to an approach to the bottom, and therefore it is possible to divide external air striking the bottom surface and allow external air from the inlet to the heat exchanger to smoothly flow on the outer surface of the drain pan.

Additionally, the drain pan has its outer surface on which the heat insulating material for drain pans is disposed, and therefore it is possible to prevent dew drops from being generated on the outer surface of the drain pan, and it is possible to make it difficult to stain the inside and outside of the apparatus with dew condensation water or make it difficult to stain a place under the apparatus body with dew condensation water that has dropped.

Additionally, if the housing has a filter member attached so as to cover at least the inlet, it is possible to prevent small birds or insects from intruding into the apparatus or prevent dirt from entering the apparatus by means of the filter member. If a high efficiency filter, such as a HEPA filter, is used as the filter member, it is also possible to prevent pollens or dust, such as PM 2.5, from entering the room.

Additionally, if the housing is formed such that the front wall portion swells in a direction opposite to the base portion, the employment of this shape makes it possible to make strength against stress applied from the outside greater than in a case in which the front wall portion is formed only of a flat surface. Additionally, for example, if the housing is installed outdoors, it is possible to reduce a load applied to the front wall portion while diverting wind and rain.

Additionally, it is possible to take the interval between the heat exchanger and the inner surface side of the front wall portion as a wider interval than in a case in which the front wall portion is formed only of a flat surface, and therefore it is possible to prevent a thermal influence from being exerted on the heat exchanger or it is possible to make it difficult to exert a thermal influence on the heat exchanger even if the front wall portion, etc. has heat because of direct sunlight, etc. on the assumption that the housing is installed outdoors.

In order to achieve the aforementioned object, the ventilation system of the present invention includes an outer wall of a building in which a ventilating hole is formed and that has an introducing passage that connects the ventilating hole and an indoor space together and an external-air conditioning apparatus, and the external-air conditioning apparatus includes a fin tube type heat exchanger that is incorporated into a heat medium circuit of an air conditioning apparatus disposed outside the external-air conditioning apparatus and a housing, and the housing includes a base portion in which the heat exchanger is stored and that has an outlet formed so as to lead to the ventilating hole, the base portion being attached to the outer wall that is outside the building, a front wall portion that is disposed so as to face the base portion and that includes a first insulation structure portion, a peripheral wall portion that is disposed between the front wall portion and the base portion and that includes a second insulation structure portion in which an inlet capable of introducing external air is formed at a position distant from the outlet, a heat-exchanger-holding structure portion in which the heat exchanger is attached in such a way that a longitudinal direction of a fin of the heat exchanger and a direction from the inlet toward the outlet substantially coincide with each other and in which the heat exchanger is held so as to have a predetermined interval between the heat exchanger and an inner surface of the front wall portion, between the heat exchanger and an inner surface of the base portion, and between the heat exchanger and an inner surface of the peripheral wall portion, and a water receiving portion disposed between the heat exchanger and the inlet.

Herein, the ventilation system of the present invention is capable of introducing external air and performing indoor ventilation by allowing the outer wall of the building to have the ventilating hole and the introducing passage. Additionally, it is possible to set the external-air conditioning apparatus on the outer wall, and therefore it is possible to introduce external air not as not-yet processed external air but as conditioned air that has been thermoregulated by the external-air conditioning apparatus through the ventilating hole and the introducing passage.

Additionally, in the ventilation system of the present invention, the heat exchanger of the external-air conditioning apparatus is incorporated into the heat medium circuit of the air conditioning apparatus (hereinafter, referred to as the "room air conditioner"), and therefore the heat exchanger is capable of heating or cooling external air introduced into the apparatus by means of a heat medium supplied in conjunction with the running of the room air conditioner while making a heat exchange between the introduced air and the heat medium, and is capable of thermoregulating air, which has undergone a heat exchange, so as to reach a temperature according to an operational purpose of the room air conditioner (according to heating or cooling).

Additionally, as a result of the interaction between the room air conditioner and the heat exchanger, a temperature difference between the aimed temperature of the room air conditioner and the temperature of a room of a building (for example, a room in which the indoor unit of the room air conditioner is installed) becomes smaller by means of conditioned air that has been supplied. As a result, the rise time of the room air conditioner becomes short without requiring a longer time, and therefore it is possible to reduce the operation load of the room air conditioner.

Additionally, the heat exchanger interacts with the running of the room air conditioner as described above, and therefore the heat exchanger itself is a structure that does not use electric power, and it is possible to contribute to energy saving by means of the thus formed structure and by means of a reduction in the rise time of the room air conditioner described above.

Still additionally, the heat exchanger is a fin tube type, which is small and light and which is excellent in heat exchange efficiency, and therefore it is possible to make the entirety of the apparatus body of the external-air conditioning apparatus small in size and light in weight. As a result, in an installed state, it is possible to reduce a load applied onto the wall surface.

Additionally, in the ventilation system of the present invention, the housing of the external-air conditioning apparatus has the base portion, and therefore it is possible to attach the apparatus so as to follow the wall surface of the building in a state in which the ventilating hole of the wall surface of the building and the outlet of the base portion lead to each other. Additionally, the presence of the outlet makes it possible to guide conditioned air outwardly.

Additionally, the housing has the front wall portion and the peripheral wall portion, and, as a result, the heat exchanger, etc. are surrounded (stored) by these portions, and therefore it is possible to prevent the heat exchanger, etc. from being deformed by an external force or from undergoing dirt adhesion. Additionally, it is possible to improve weather resistance and to lengthen the life of a product. Additionally, the inside and outside of the apparatus body are partitioned by the front wall portion and the peripheral wall portion, and therefore it is possible to prevent conditioned air from being mixed with air existing outside the apparatus that has not yet undergone a heat exchange or prevent conditioned air from diffusing outside the apparatus.

Still additionally, it is possible to introduce external air from the inlet by providing the inlet at the peripheral wall portion of the housing. Additionally, the inlet is formed at a position distant from the outlet, and therefore it is possible to restrain external air that has entered through the inlet from flowing out directly from the outlet almost without undergoing a heat exchange.

Still additionally, the external-air conditioning apparatus is capable of reducing a thermal influence from outside the apparatus when external air undergoes a heat exchange by allowing the external-air conditioning apparatus to have the first insulation structure portion and the second insulation structure portion. Hence, in the external-air conditioning apparatus, even if the outer surfaces of the front wall portion, etc. become high in temperature because of direct sunlight at a summer season or even if the outer surfaces of the front wall portion, etc. become low in temperature because of a snowstorm, etc. at a winter season, it is possible to create a state in which such heat is not transmitted directly to the inside of the apparatus (for example, to the inner surfaces of the front wall portion, etc.) or is not easily transmitted thereto. This makes it possible to restrain conditioned air from receiving a thermal influence caused by an environment existing outside the apparatus.

Additionally, the external-air conditioning apparatus is capable of holding the heat exchanger so that the heat exchanger does not come into contact with the inner surface of the front wall portion, with the inner surface of the base portion, and with the inner surface of the peripheral wall portion by having the heat-exchanger-holding structure portion, and is capable of creating a state in which a thermal transfer from the front wall portion, etc. does not directly reach the heat exchanger or does not easily reach the heat exchanger. Additionally, the longitudinal direction of the fin of the heat exchanger that is held and the direction from the inlet toward the outlet substantially coincide with each other, and therefore external air that has entered through the inlet flows along the longitudinal direction of the fin, and flows out from the outlet. As a result, a period of contact time between the external air and the fin is lengthened, and it is possible to improve heat exchange efficiency.

Additionally, the external-air conditioning apparatus has the water receiving portion, and hence can receive dew condensation water generated from the heat exchanger when refrigerated air conditioning is performed. For example, the external-air conditioning apparatus is installed in a state in which the inlet is directed downwardly, and, as a result, the position of the heat exchanger becomes upwardly higher than the inlet, and it is possible to receive dew condensation water that is generated in the heat exchanger and is then allowed to drop by means of the water receiving portion disposed between the inlet and the heat exchanger. This makes it possible to restrain the lower part of the external-air conditioning apparatus from being made dirty with the dew condensation water without allowing the dew condensation water to directly drop downwardly from the inlet. Additionally, if the external-air conditioning apparatus is installed in a state in which the inlet is directed downwardly, dew drops generated on the front surface of the fin are dropped along the fin because the water receiving portion is placed on an extension in the longitudinal direction of the fin of the heat exchanger, and therefore it is possible to efficiently gather dew condensation water.

Additionally, the water receiving portion is positioned between the heat exchanger and the inlet, and therefore, for example, when it is rainy weather with strong wind, rainwater engulfed together with external air from the inlet strikes the water receiving portion, and is then repelled, and therefore it is possible for rainwater not to easily adhere directly to the heat exchanger.

Additionally, if the present invention provides a room air conditioner, which has an indoor unit that performs air-conditioning of a room of the building, an outdoor unit installed outside the building, and a heat medium circuit that is a connection piping by which the outdoor unit and the indoor unit are connected together and which interacts with the external-air conditioning apparatus, the external-air conditioning apparatus interacts with the room air conditioner that is running, and therefore conditioned air introduced for ventilation is heated-air or cooled-air, and it is possible to help a rise in temperature of indoor air (when heated) or a fall in temperature of indoor air (when cooled), and therefore it becomes possible to condition indoor air in a shorter period of time. As a result, it is possible to shorten the rise time of the room air conditioner, and therefore it is possible to further raise the effect of reducing the operation load of the room air conditioner that conditions indoor air, and hence contribute to energy saving.

Advantageous Effects of Invention

According to the external-air conditioning apparatus of the present invention, it is possible to install the external-air conditioning apparatus in new or already-existing housing complexes, etc. more easily, and it is possible to have improved workability in maintenance, etc., and it is possible to decrease the operation load of a room air conditioner installed in a room so as to realize energy savings when compared to the conventional external-air conditioning apparatus. Additionally, according to the ventilation system of the present invention, it is possible to install the ventilation system as a ventilation system for a new or already-existing ordinary house or housing complex more easily, and it is possible to have improved workability in maintenance, etc., and it is possible to decrease the operation load of a room air conditioner installed in a room so as to realize energy saving when compared to the conventional ventilation system.

BRIEF DESCRIPTION OF DRAWINGS

FIG. 5 is a partial cross-sectional view of the external-air conditioning apparatus of FIG. 4, wherein FIG. 5A is a cross-sectional view along line A-A on base body side, and FIG. 5B is a cross-sectional view along line B-B on the cover body side.

DESCRIPTION OF EMBODIMENTS

Embodiments of the present invention will be described in more detail with reference to FIG. 1 to FIG. 10. Reference signs in each drawing are given in such a limited way as to reduce complication and facilitate understanding. An external-air conditioning apparatus 1 and a ventilation system V using this apparatus will be first described with reference to FIG. 1 to FIG. 10, and then modifications (Modifications 1 to 6) of components of the external-air conditioning apparatus 1 will be described with reference to FIG. 11 to FIG. 14.

[External-Air Conditioning Apparatus 1]

Figure 1:
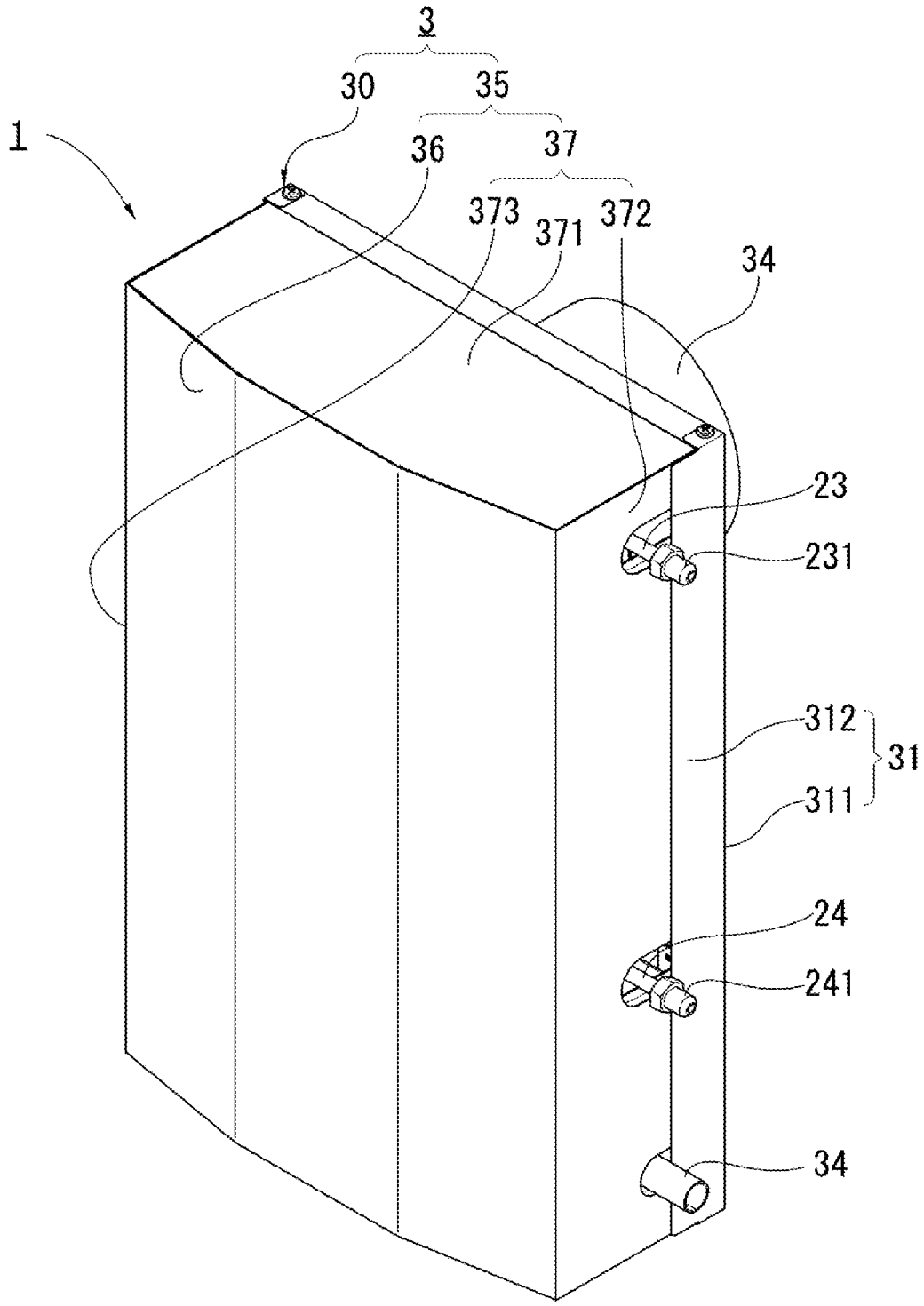
FIG. 1 is a perspective view of an external-air conditioning apparatus of the present invention shown obliquely from above on the front side.
Figure 2:
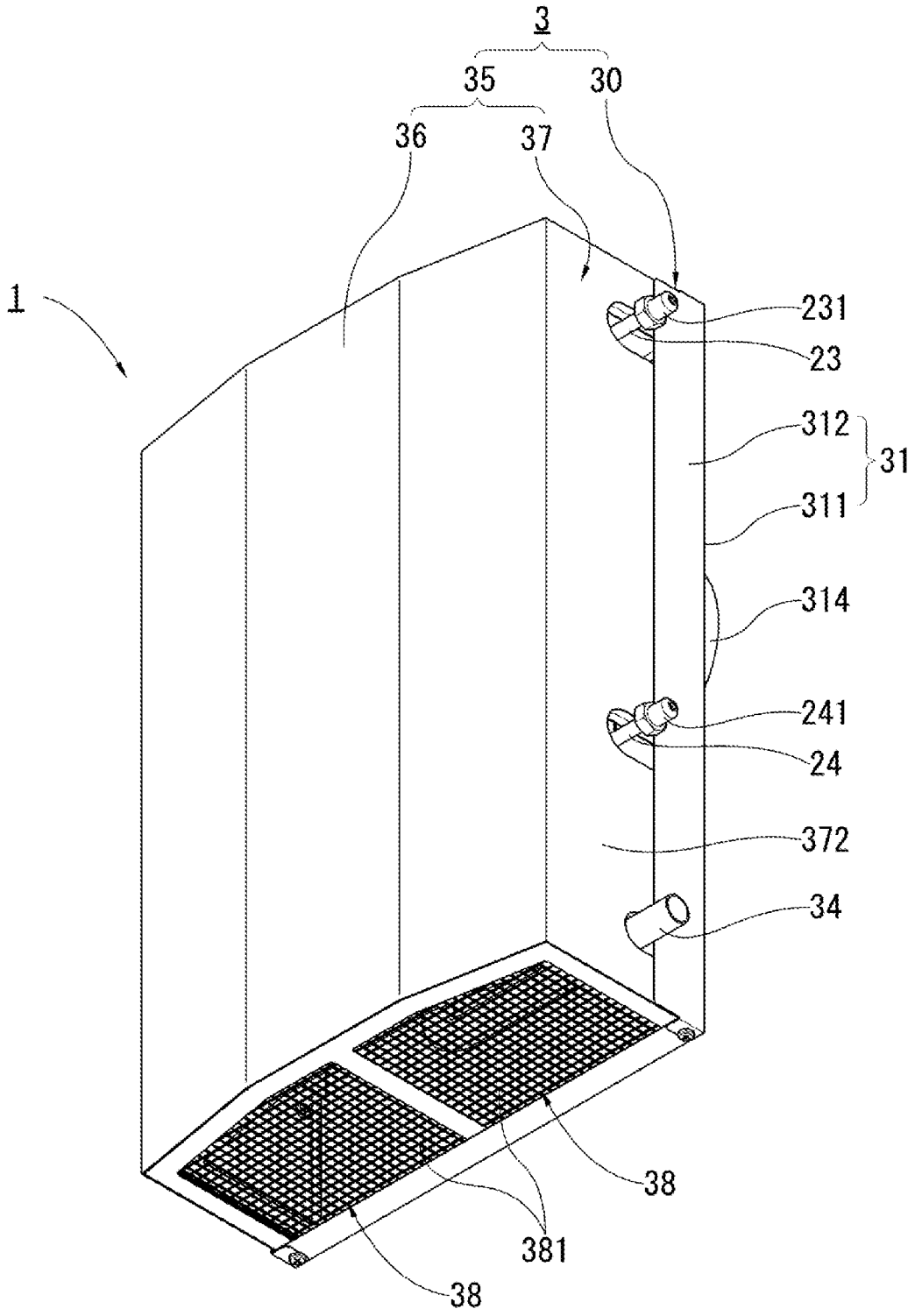
FIG. 2 is a perspective view of the external-air conditioning apparatus of FIG. 1 shown obliquely from below on the front side.
Figure 3:
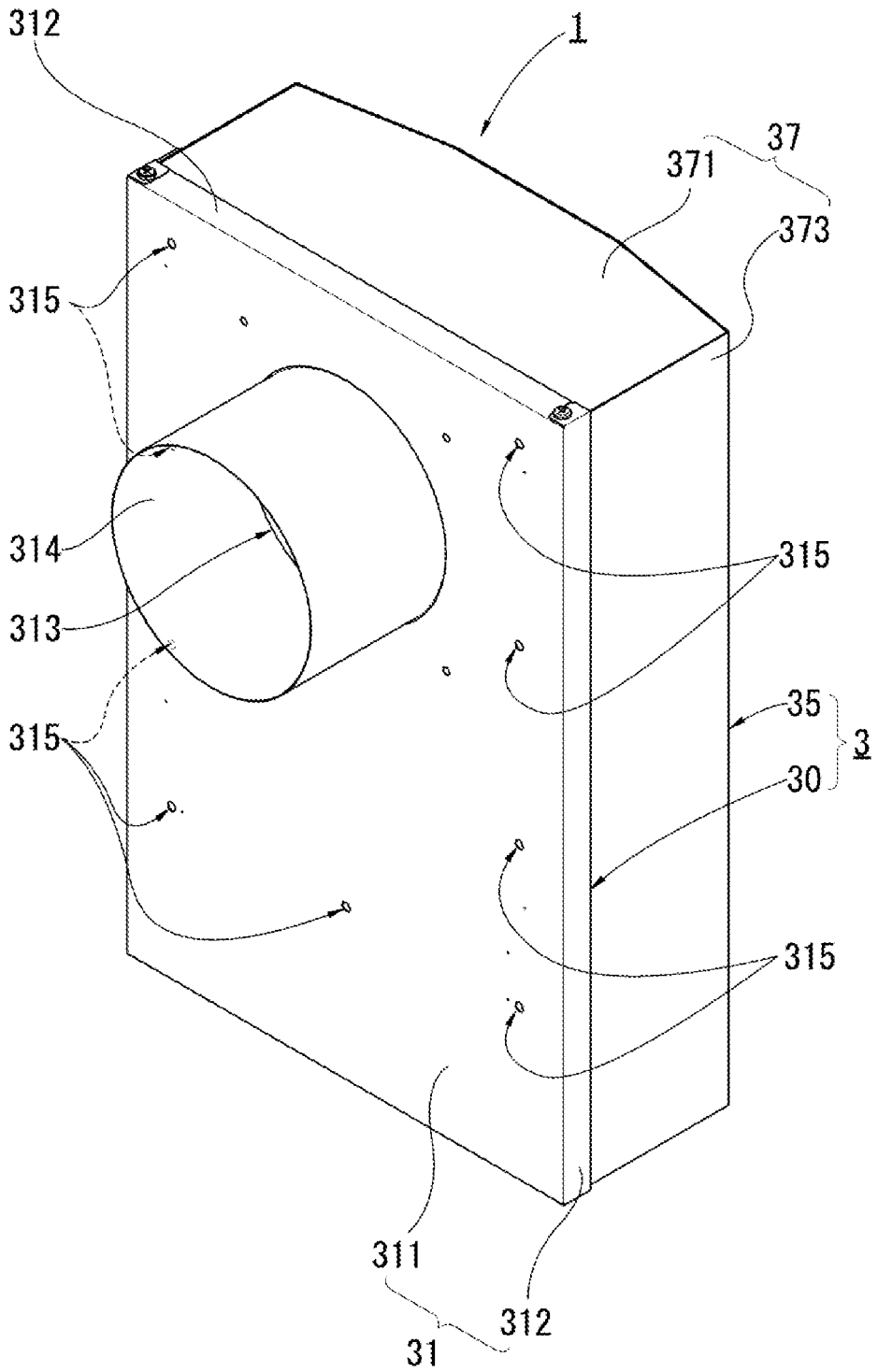
FIG. 3 is a perspective view of the external-air conditioning apparatus of FIG. 1 shown obliquely from above on the back side.
Figure 4:
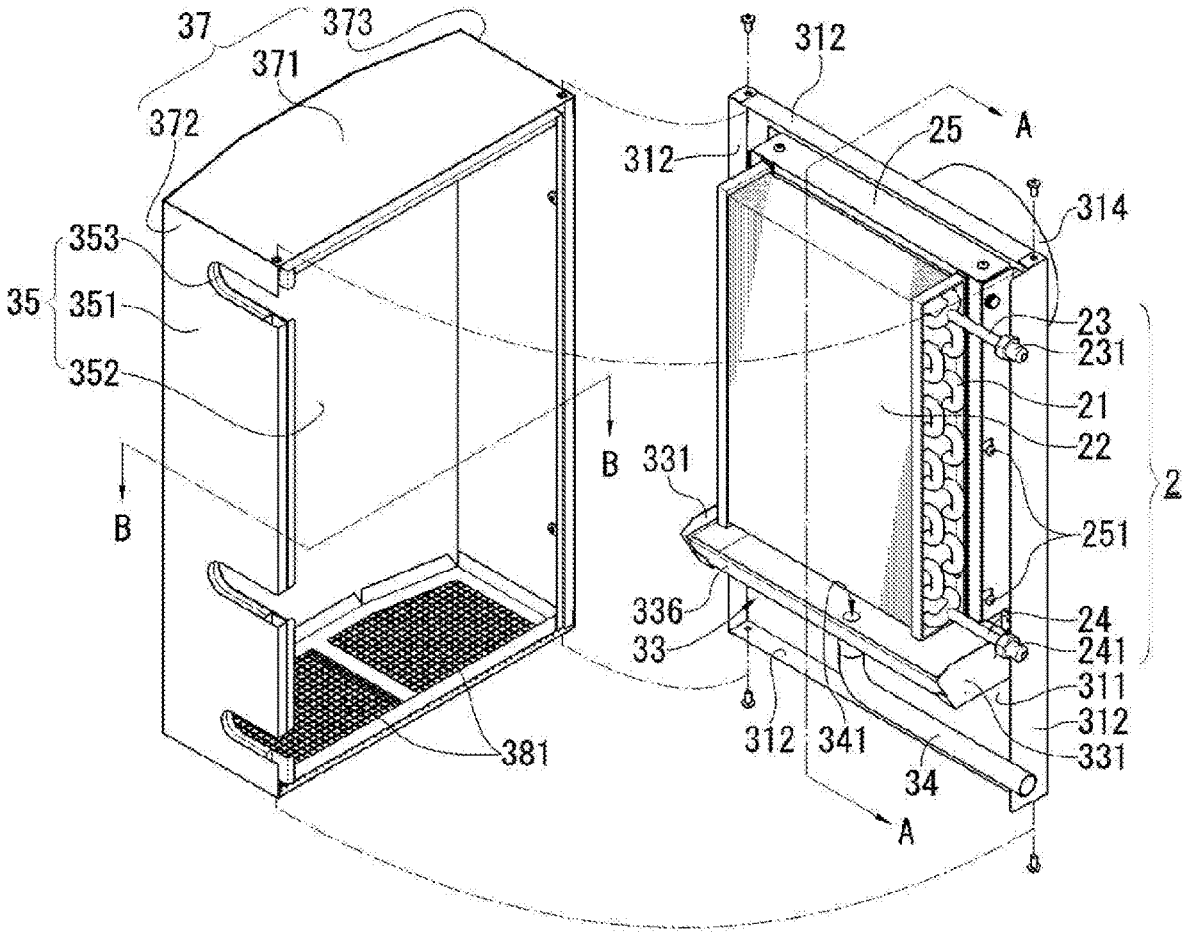
FIG. 4 is a perspective descriptive view showing a disassembled state in which a cover body of the external-air conditioning apparatus of FIG. 1 has been detached.
Figure 5:
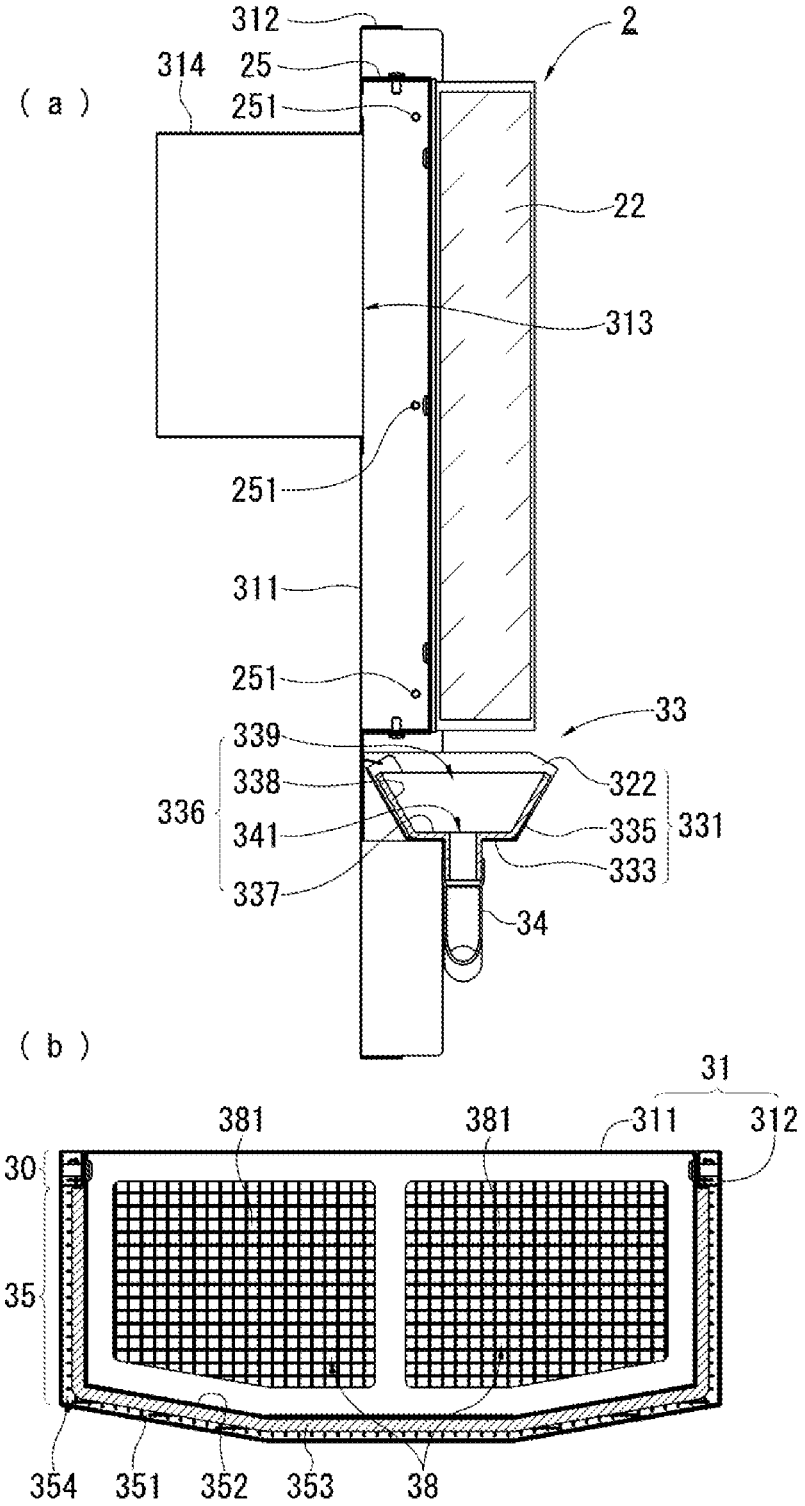
Figure 6:
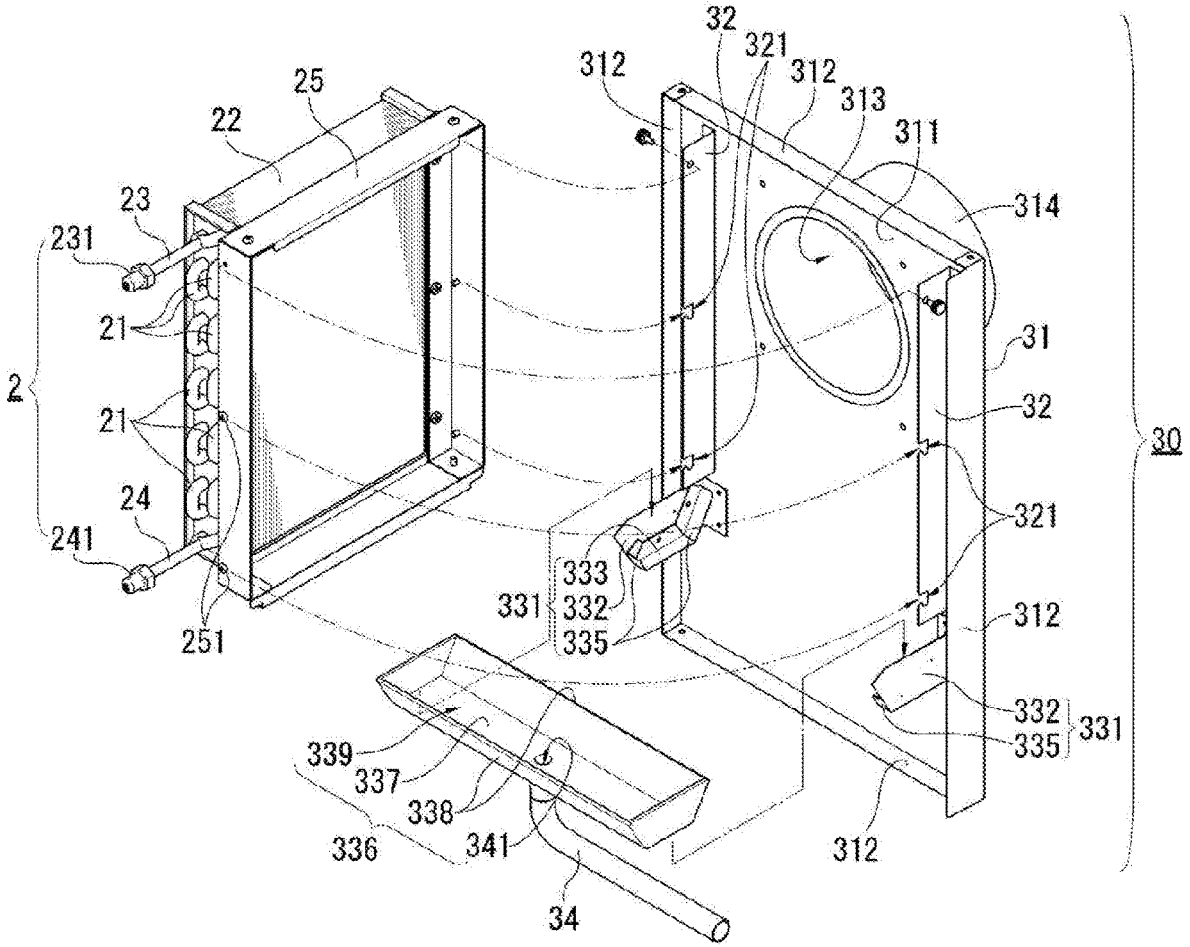
FIG. 6 is a perspective descriptive view showing a state in which the base body of the external-air conditioning apparatus of FIG. 4 has been disassembled into its components.
Figure 7:
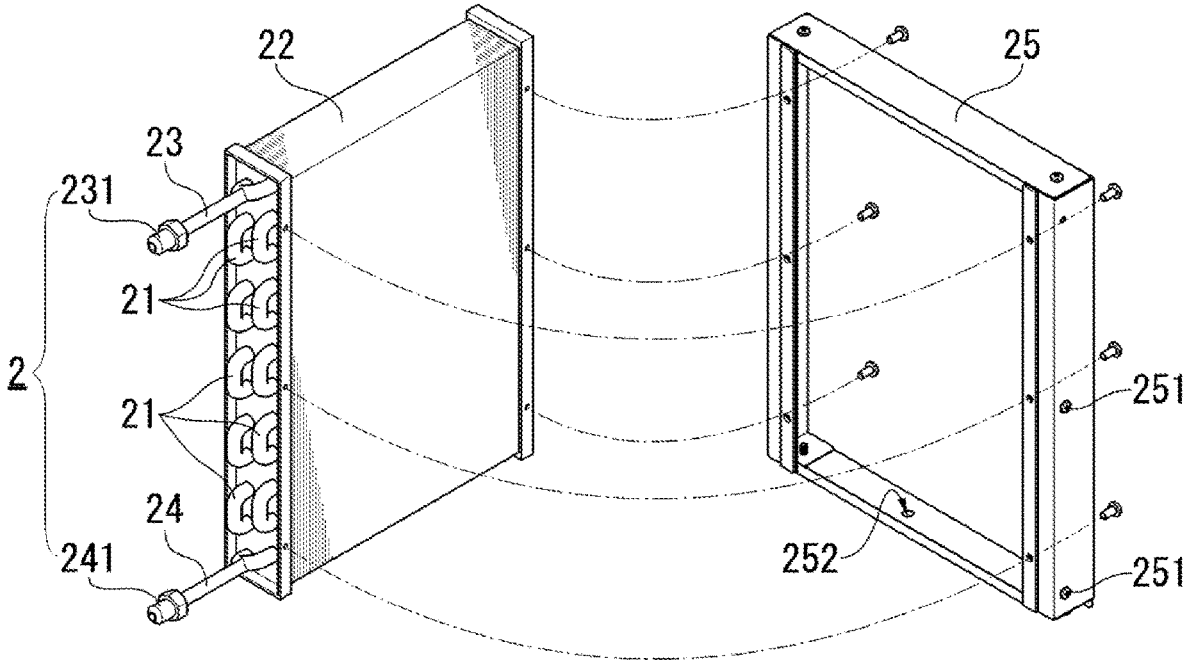
FIG. 7 is a perspective descriptive view showing a disassembled state in which a heat exchanger and a partitioning portion of the external-air conditioning apparatus of FIG. 6 have been detached.
Figure 8:
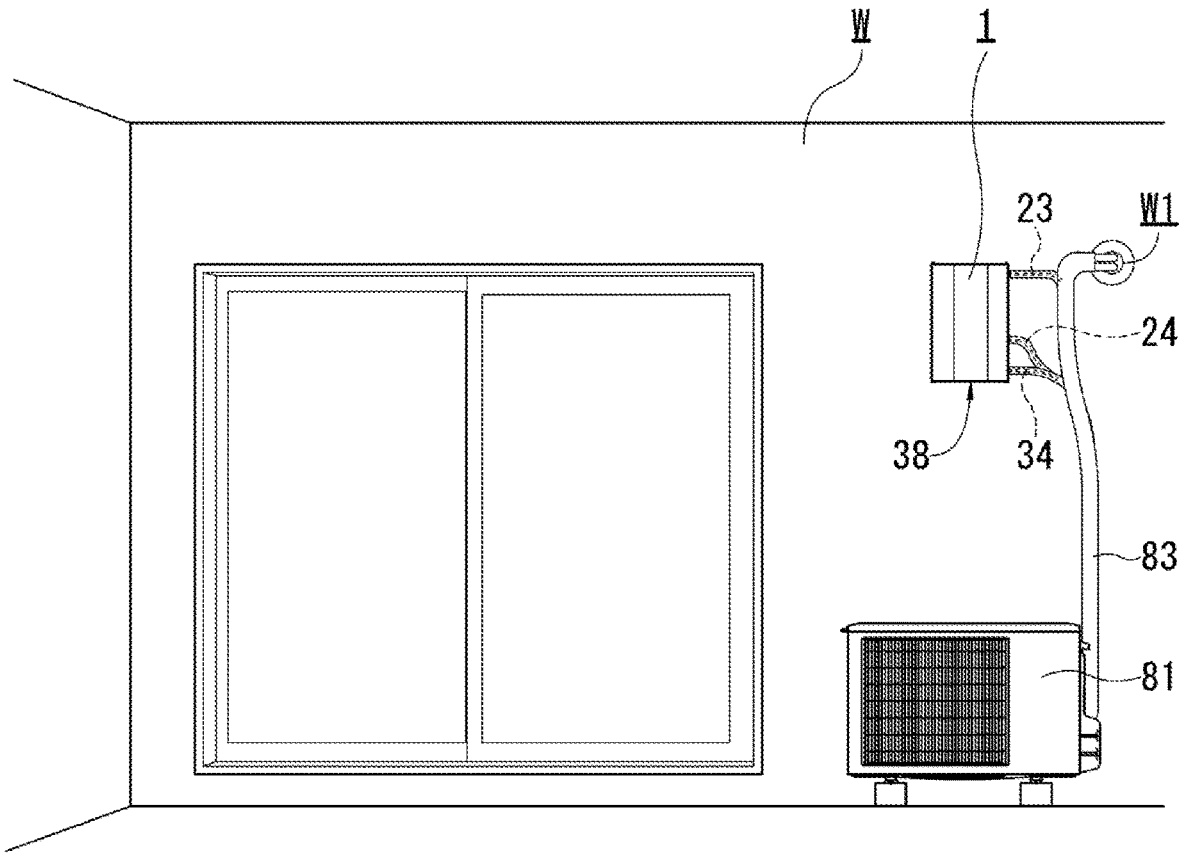
FIG. 8 is a perspective descriptive view showing an installation example of the external-air conditioning apparatus of FIG. 1.
Figure 9:
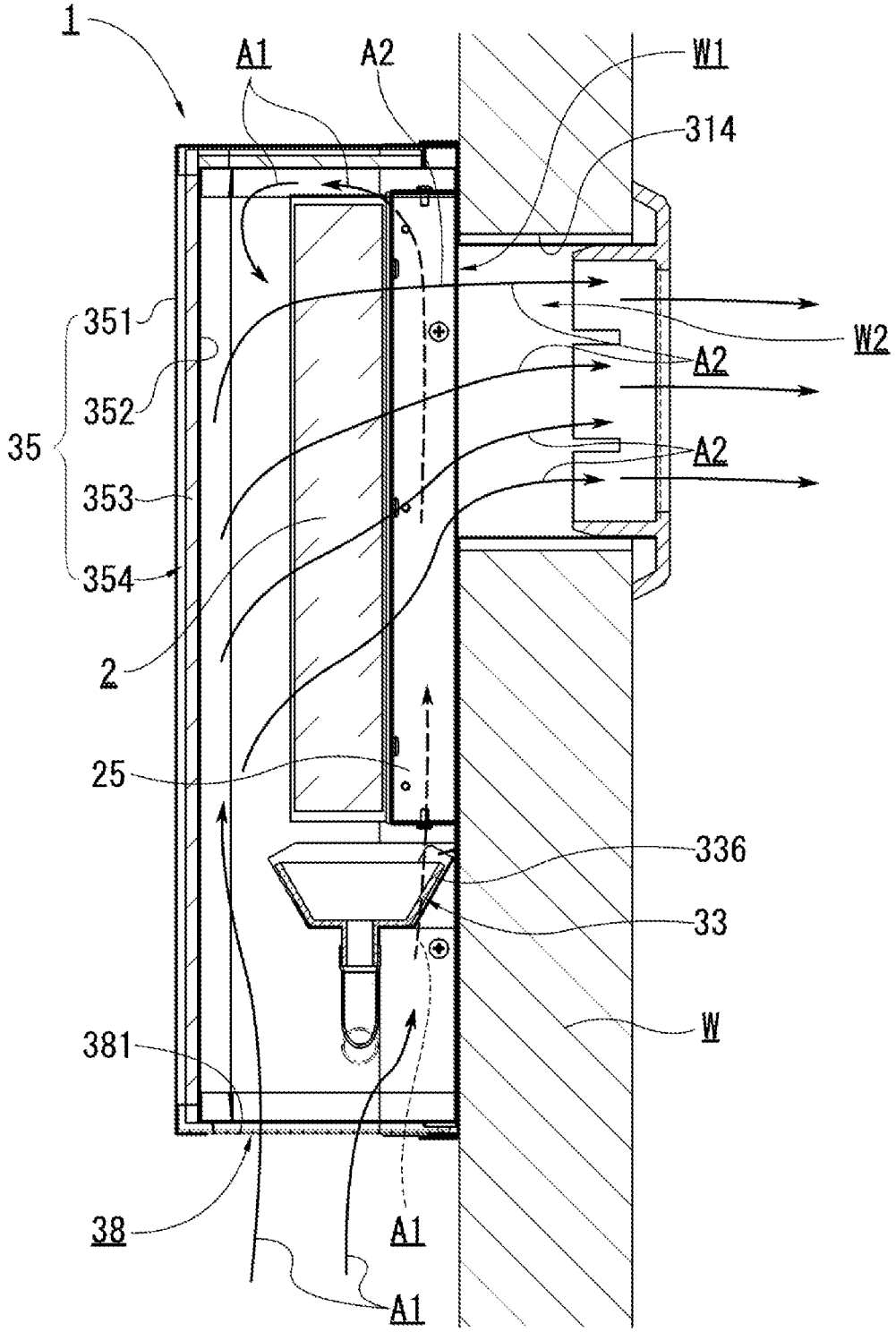
FIG. 9 is a schematic view in which the flow direction of air of a ventilation system of the present invention is indicated by arrows.
Figure 10:
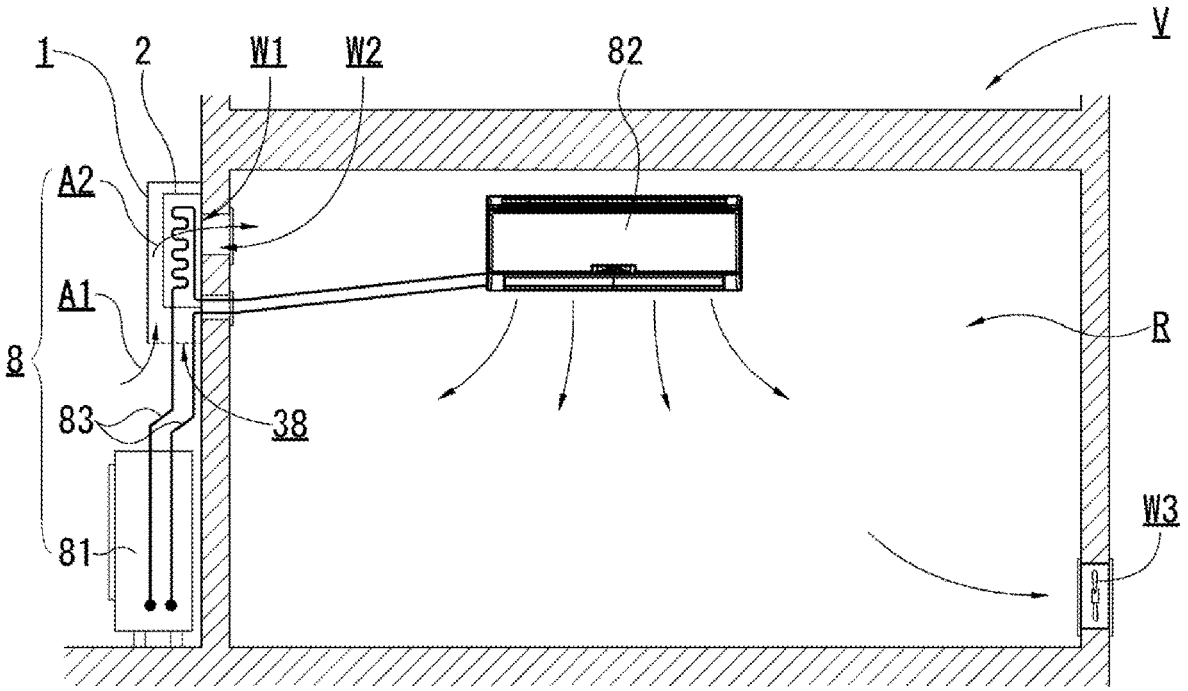
FIG. 10 is a schematic view of a house in which the ventilation system of the present invention has been installed.

The external-air conditioning apparatus 1 is composed of a fin tube type heat exchanger 2 and a housing 3 in which the heat exchanger 2 is stored and that is attached along a wall surface W of a building. The external-air conditioning apparatus 1 is set on the wall surface W in such a way as to fit an outlet 314 (described later) to a ventilating hole W1 formed in the wall surface W of the building as shown in FIG. 8 to FIG. 10. The components of the external-air conditioning apparatus 1 will be hereinafter described.

<Heat Exchanger 2>

The heat exchanger 2 is capable of making a heat exchange with external air A1 introduced into the housing 3, and is a so-called fin tube type that consists of a heat-transfer pipe 21 having a meander shape in which a linear part and a folded part alternately continue and a plurality of fins 22 that intersect the radial direction of the heat-transfer pipe 21. The heat exchanger 2 is disposed so that the axial direction of each stage of the linear part of the heat-transfer pipe 21 and the vertical direction of the external-air conditioning apparatus 1 that has been installed intersect perpendicularly to each other, thus making it possible to prevent a lubricant ingredient included in a refrigerant from gathering in the folded part.

The heat exchanger 2 has a first in-and-out pipe 23 and a second in-and-out pipe 24 that are connected to the heat-transfer pipe 21, and a joint portion 231 is disposed at a front end of the first in-and-out pipe 23, and a joint portion 241 is disposed at a front end of the second in-and-out pipe 24. The joint portions 234 and 241 are connectable to and disconnectable from a refrigerant piping 83 connected to a room air conditioner 8. The first in-and-out pipe 23 and its joint portion 231 and the second in-and-out pipe 24 and its joint portion 241 are disposed on the same lateral surface of the housing 3, so that the refrigerant piping 83 connected to these joint portions are easily routed.

The heat exchanger 2 has a structure in which a refrigerant supplied from an outdoor unit 81 (described later) of the room air conditioner 8 installed outdoors through the refrigerant piping 83 is circulated, and a heat exchange is performed with external air A1. The supply of the refrigerant is started in response to the startup of the room air conditioner 8, and is stopped by the shutdown of the room air conditioner 8. In other words, the heat exchanger 2 has a structure in which the operation of the heat exchanger 2 is dependent on the running of the room air conditioner 8 (i.e., utilizes the running of the room air conditioner 8), and electric power or mechanical power other than power for the room air conditioner 8 is not required.

Additionally, both the external-air conditioning apparatus 1 and the outdoor unit 81 are to be installed outdoors, and, in many cases, the ventilating hole and the outdoor unit 81 are disposed near each other in a general housing complex as shown in FIG. 9. Additionally, the external-air conditioning apparatus 1 is set on the wall surface W in such a way as to fit the ventilating hole W1 and the outlet 314 to each other, and, in other words, the external-air conditioning apparatus 1 is close to the outdoor unit 81 outdoors, and therefore the refrigerant piping 83 requires a shorter length, and piping work taken into consideration of a routing path is needless, and therefore the labor for installation requires more shortened hours. Additionally, the heat exchanger 2 is disposed to have a size that enables the outlet 314 to be covered, and a predetermined interval is created between the heat exchanger 2 and the outlet 314 by means of a heat-exchanger-holding structure portion 32 and a partitioning portion 25 (described later), and the heat exchanger 2 is held in such a manner as to cover the outlet 314 when viewed from the front of the apparatus body.

The partitioning portion 25 is disposed between the heat exchanger 2 and a base portion 31 (described later). The partitioning portion 25 is a square four-way frame, and is formed in such a manner as to direct a C-shaped opening part of a channel material in a cross-sectional view in an inside-frame direction. Additionally, the partitioning portion 25 is set so that an inner shape (rim part) of the opening portion inside the frame substantially coincides with an outer shape of the heat exchanger 2, and the heat exchanger 2 is detachably attached so as to close the opening portion. Additionally, the partitioning portion 25 is attached to place the outlet 314 (described later) in a region inside the frame, and partitions the frame into an inner side and an outer side, and creates a space having a predetermined width between the base portion 31 and the heat exchanger 2 that has been installed.

The partitioning portion 25 has a drain hole 252 formed in a part directed toward a water receiving portion 33 (described later) when the partitioning portion 25 is attached, so that dew condensation water that has dropped from the heat exchanger 2 into the partitioning portion 25 can be drained into the water receiving portion 33. Additionally, the partitioning portion 25 has screw holes (not shown) formed in left and right side surfaces fixed when the partitioning portion 25 is attached, and a locking screw 251 is screwed into the screw hole.

The screw hole and the locking screw 251 are provided so as to correspond in position and in number to a locking notch 321 of the heat-exchanger-holding structure portion 32 (described later), and the partitioning portion 25 (and the heat exchanger 2 that has been attached) can be detachably attached to the heat-exchanger-holding structure portion 32 by latching the locking screw 251 into the locking notch 321.

<Housing 3>

The housing 3 is made chiefly of a metallic material, and is composed of a base body 30 that is disposed on the back side of the apparatus body when the housing 3 is set along the wall surface W of the building and a cover body 35 that is disposed on the front side of the apparatus body, and the base body 30 and the cover body 35 are configured to have a divisible structure in which the cover body 35 is attachable to or detachable from the base body 30. The attachable/detachable structure of both the base body 30 and the cover body 35 is formed by boring screw holes (not shown) at positions corresponding to each other of the base body 30 and the cover body 35 and by allowing screw holes bored at mutually corresponding positions to lead to each other and then inserting screws (no reference sign) into the screw holes, respectively. Each component of the housing 3 will be hereinafter described.

<Base Body 30>

The base body 30 has the base portion 31, a connecting pipe portion 314, the heat-exchanger-holding structure portion 32, and the water receiving portion 33.

The base portion 31 consists of a base plate portion 311 and a peripheral wall portion 312 that are formed integrally with each other, and the base plate portion 311 is rectangular and tabular and is shaped to follow the wall surface W of the building, and the peripheral wall portion 312 rises toward the front from an outer edge of the base plate portion 311 (i.e., in a direction of the cover body 35 to be attached). The base portion 31 is provided to have a size that enables a Peripheral wall portion 37 of the cover body 35 (described later) to exactly fit in the inside of the peripheral wall portion 312. The base portion 31 has an outlet 313 to guide conditioned air A2 that is formed near an upper edge of the base portion 31. The outlet 313 is an opening that has a size corresponding to the ventilating hole W1 bored in the wall surface W of the building.

The base plate portion 311 has a plurality of through-holes 315 into each of which an attaching member (hereinafter, referred to as "screws, etc."), such as bolt, screw, nail, pin, or anchor bolt that is used to set the apparatus on the wall surface W of the building can be inserted. In detail, screws, etc. are appropriately provided around the outlet 313 and at a part that is not hidden by the heat exchanger 2 when the heat exchanger 2 is attached to the base portion 31.

The connecting pipe portion 314 is a cylindrical member that is formed along a rim of the outlet 313 on the back side of the base portion 31 (an outer surface of the apparatus body). The connecting pipe portion 314 has a size that enables connecting pipe portion 314 to be fitted into the ventilating hole W1 in which the connecting pipe portion 314 is to be mounted, and it is preferable to design its outer diameter and the inner diameter of the ventilating hole W1 so as to be substantially equal to each other.

The heat-exchanger-holding structure portion 32 is a structure in which the heat exchanger 2 is attached in such a way that the longitudinal direction of a fin of the heat exchanger 2 and the direction from an inlet 38 toward the outlet 313 substantially coincide with each other. As described above, the external-air conditioning apparatus 1 is installed so that the inlet 38 is directed downwardly, and therefore the heat-exchanger-holding structure portion 32 holds the heat exchanger 2 in such a way that the longitudinal direction of the fin of the heat exchanger 2 substantially coincides with the vertical direction of the apparatus body in the installed state of the apparatus body.

The heat-exchanger-holding structure portion 32 is a pair of plates that uprise from the base portion 31 in the direction of the cover body 35, and the pair of plates are along outer edges of both right and left sides of the base portion 31, respectively, and are disposed at positions with predetermined intervals from the outer edges, respectively. Additionally, each plate is provided with locking notches 321 between which a predetermined interval exists in the longitudinal direction, and each locking notch 321 is formed in the shape of a hook that goes down from a front end of the plate (i.e., front side of the apparatus body) toward the lower-part side of the apparatus body.

The heat-exchanger-holding structure portion 32 is configured as above, thus making it possible to lock the partitioning portion 25 and the heat exchanger 2 attached to the partitioning portion 25 in such a way as to hitch a neck part of the locking screw 251 of the aforementioned partitioning portion 25. In this locking state, it is possible to hold the partitioning portion 25 including the heat exchanger 2 from the width direction of the apparatus body, and it is possible to hold the partitioning portion 25 including the heat exchanger 2 so as to have a predetermined interval between the inner surface of a front wall portion 36 and the heat exchanger 2, between the inner surface of the base portion 31 and the heat exchanger 2, and between the inner surface of the peripheral wall portion 37 and the heat exchanger 2.

The water receiving portion 33 is disposed between the heat exchanger 2 and the inlet 38, and has a structure including a water-receiving support portion 331, a drain pan 336, a drain passage 34, and a heat insulating material 342 for drain pans.

The water-receiving support portion 331 uprises from the base portion 31 toward the front side of the apparatus body, and is disposed so as to follow the right-left direction of the apparatus body with an interval of distance slightly longer than the length in the longitudinal direction of the drain pan 336. The water-receiving support portion 331 has side portions 332 separately disposed with a predetermined interval in a direction along right and left outer edges of the base portion 31, a bottom portion 333 connected to the side portion 332, and an upper portion 334. The bottom portion 333 has uprising parts 335 formed in the forward and backward directions of the apparatus body. The water-receiving support portion 331 is configured as above, and hence has a shape that enables the drain pan 336 to be supported detachably and to be supported so that the drain pan 336 does not easily come off when the drain pan 336 is attached.

The drain pan 336 has a bottom surface 337 and four lateral surfaces 338 that uprise from the bottom surface 337, and is shaped to have an opening portion 339 whose upper side (i.e., a side that faces the heat exchanger 2) is open. The drain pan 336 is provided so as to become slightly wider than an end surface (lower surface) 260 of the heat exchanger 2 faced by the opening portion 339. The drain pan 336 gradually becomes smaller in width in proportion to the approach of the lateral surface 338 to the bottom.

The drain passage 34 is a tube in which one end leads to a drain hole 341 formed in an inner bottom surface of the drain pan 336, and the other end is guided outwardly from the apparatus, and is configured so that water, such as dew condensation water, that has dropped into the drain pan 336 and that has gathered inside the apparatus can be drained outwardly from the apparatus. In the drain passage 34, no limitations are imposed on how its forward portion is connected, and, for example, its forward portion may be connected to a drain piping of the air conditioner, or may be connected to a rainwater/wastewater drainage system. Additionally, if the ground exists under the external-air conditioning apparatus 1, the drain passage 34 may be open merely outdoors.

The heat insulating material 342 for drain pans is a sheet-shaped heat insulating material, and is pasted onto the outer surface of the drain pan 336.

<Cover Body 35>

The cover body 35 has a front wall portion 36 disposed at a position facing the base portion 31 in a state in which the cover body 35 has been attached to the base body 30 and a three-side peripheral wall portion 37 extending in the direction of the base portion 31 from an outer edge portion of the front wall portion 36, and one part in which the peripheral wall portion 37 is not formed is used as the inlet 38 of external air A1, and a filter member 381 is attached so as to cover the inlet 38.

The peripheral wall portion 37 is configured to include a peripheral-wall upper surface portion 371 that serves as an upper surface, a peripheral-wall right surface portion 372 that serves as a right side surface, and a peripheral-wall left surface portion 373 that serves as a left side surface in the state of having been set on the wall surface W (i.e., the opened lower surface portion serves as the inlet 38). In the state of having been set on the wall surface W, the aforementioned outlet 313 is positioned on the peripheral-wall-upper-surface-portion-371 side, and the inlet 38 is positioned at the lower part of the cover body 35. In other words, the inlet 38 is formed at a "position far from the outlet 313."

The cover body 35 is a structure in which the front wall portion 36 and the three-side peripheral wall portion 37 are formed integrally with each other. Additionally, the cover body 35 is a structure consisting of an outer surface plate 351 that serves as an outer surface of the apparatus body, an inner surface plate 352 that serves as an inner surface of the apparatus body, and a heat insulating material 353 disposed between the inner surface plate 352 and the outer surface plate 351 (which corresponds to the aforementioned first insulation structure portion and the aforementioned second insulation structure portion).

The inner surface plate 352 and the outer surface plate 351 are disposed with a predetermined interval between the inner surface plate 352 and the outer surface plate 351 so as to create a void therebetween, and the sheet-shaped heat insulating material 353 is stuck on the inner surface plate 352 with an adhesive. In this void, a thermal insulation region 354 that is a gap having a predetermined interval is formed between a surface on the side opposite to the adhesive of the heat insulating material 353 (which is referred to as a "front surface" for descriptive convenience) and the outer surface plate 351.

The cover body 35 is provided to have a shape in which the front wall portion 36 swells in a direction opposite to the base portion 31 (i.e., "frontal direction of the apparatus body"). The front wall portion 36 has two bent parts along the longitudinal direction of the apparatus body, and consists of three surfaces, i.e., consists of a front part that is substantially parallel to the base portion 31 and inclined parts in each of which a part between each of the bent parts above that serve as long edge parts of the front part and each of the peripheral wall portions 37 on left-and-right both sides descends and inclines in the direction of the base portion 31.

At least a surface, which is on the outside of the apparatus, of the outer surface plate 351 is formed in a shape that enables water repellency, or is subjected to water-repellent coating. At least a surface, which is on the inside of the apparatus, of the inner surface plate 352 is subjected to treatment for thermal reflectability.

[Ventilation System V]

The ventilation system V is an indoor ventilation system of a building, and is composed of the wall surface W of the building, the aforementioned external-air conditioning apparatus 1, and the room air conditioner 8. The ventilation system V will be hereinafter described with reference chiefly to FIG. 9 to FIG. 11. A description of the external-air conditioning apparatus 1 has been made as above, and hence is omitted.

<Outer Wall of Building>

The wall surface W of the building is an outer wall that faces a place at which the outdoor unit 81 is disposed, and a ventilating hole W1 is formed at a higher position in the wall surface W. An introducing passage W2 is formed so as to lead to the ventilating hole W1 and so as to pass through the wall from an outdoor space to an indoor space. The connecting pipe portion 314 of the external-air conditioning apparatus 1 is connected to the ventilating hole W1, and conditioned air A2 that has been heated or cooled by the external-air conditioning apparatus 1 is introduced into the room through the ventilating hole W1 and the introducing passage W2.

<Room Air Conditioner 8>

The room air conditioner 8 has an indoor unit 82 disposed at a higher position in the room of the building and the outdoor unit 81 disposed outdoors, and the indoor unit 82 and the outdoor unit 81 are connected together by means of the refrigerant piping 83. The refrigerant piping 83 branches off in the indoor unit 82 and the outdoor unit 81, and a refrigerant that circulates in the heat exchanger 2 of the external-air conditioning apparatus 1 can be supplied through the refrigerant piping 83 that has branched off. The supply of the refrigerant is performed in a manner in which the indoor unit 82, the outdoor unit 81, and the external-air conditioning apparatus 1 are connected in series as shown in FIG. 10. According to the manner of being connected in series, the structure is simple, and therefore a construction operation is easily performed.

The attachable/detachable structure between the base body and the cover body in the present embodiment is to insert a screw into a screw hole bored in the base body 31 and in the cover body 35 as described above, and yet the present invention is not limited to this, and, for example, a steady pin may be used instead of the screw, or a latch structure or a similar structure in which latching is performed between a hook-shaped part and a cutout part may be employed.

The housing 3 in the present embodiment is disposed such that the front wall portion swells in a direction opposite to the base portion, and yet the present invention is not limited to this, and the front wall portion may be, for example, tabular, and, in this case, it is preferable to be reinforced by a structure (such as a reinforcing rib) that is resistible against an external force applied to the front wall portion. Additionally, the housing in the present embodiment is made chiefly of a metallic material, and yet the present invention is not limited to this, and, for example, synthetic resin, etc. that have heat resistance, water resistance, and weather resistance may be employed as part of or all of its constituent material.

A filter member is attached to the inlet of the housing 3 in the present embodiment, and yet the present invention is not limited to this, and a filter member may be attached to, for example, an indoor-side part of the outlet or of the ventilating hole. Additionally, if a filter member that can capture pollens, PM 2.5, etc. is disposed at, for example, an indoor-side part of the ventilating hole, it is possible to diligently perform maintenance from the indoor side.

The partitioning portion 25 in the present embodiment is formed detachably from the heat exchanger and from the base portion, and yet the present invention is not limited to this, and, for example, the partitioning portion 25 may be formed integrally with the heat exchanger or with the base portion. Additionally, the inside of the partitioning portion 25 in the present embodiment is a void, and yet the present invention is not limited to this, and, for example, a heat storage member may be included. In the room air conditioner 8, when the room temperature reaches a preset temperature, the refrigeration cycle is stopped, so that the supply of a refrigerant to the external-air conditioning apparatus 1 is stopped (the circulation of a refrigerant is stopped), and yet, if a heat storage member is included in the partitioning portion 25, external air that is continuously introduced can be thermoregulated.

The housing 3 in the present embodiment has the base portion at which the base body, the heat-exchanger-holding structure portion, and the water receiving portion are disposed, and yet the present invention is not limited to this, and, for example, either the heat-exchanger-holding structure portion or the water receiving portion may be disposed at the cover body, or both the heat-exchanger-holding structure portion and the water receiving portion may be disposed at the cover body.

The term "outer wall of the building" used in the present embodiment denotes, in addition to a wall that divides the space into an indoor space and an outdoor space, a wall that divides the space into a room space in which the indoor unit is installed and a space outside the room in an environment in which the outdoor unit is installed even in the building (even in the indoor space).

The cover body 35 in the present embodiment has the aforementioned structure, and yet the present invention is not limited to this, and, for example, the cover body 35 is not necessarily required not to have a thermal insulation region, and the cover body 35 may be made of a single material if the material has properties (weather resistance, mildew resistance, etc.) required by the outer and inner surfaces of the apparatus body, and is provided with thermal insulation. In other words, the cover body 35 includes not only a structure composed of the outer surface plate, the inner surface plate, and the heat insulating material but also, for example, a structure consisting of a monoplate that has thermal reflection and thermal insulation. Additionally, the heat insulating material disposed in the cover body is not limited in kind and in material, and, preferably, the heat insulating material has at least any one of dust resistance, mildew resistance, antifungal properties, water resistance, and chemical resistance in addition to thermal insulation.

The mounting parts of both the base body 30 and the cover body 35 in the present embodiment are attached in such a way as to insert the wall portion 37 of the cover body 35 into the inside of the peripheral wall portion 312 of the base portion 31 (i.e., the peripheral wall portion 37 of the cover body 35 is fitted into the inside of the peripheral wall portion 312 of the base portion 31), and yet the present invention is not limited to this, and, for example, the mounting parts may be attached in such a way as to allow the peripheral wall portion of the base portion to enter the inside the peripheral wall portion of the cover body (i.e., the cover body is fitted onto the peripheral wall portion of the base portion).

In the heat exchanger 2 in the present embodiment, the heat-transfer pipe 21 is a copper pipe, and each of the fins 22 is an aluminum alloy, and yet the present invention is not limited to this, and, for example, the heat-transfer pipe 21 and the fin 22 may be each a metal, such as stainless steel or titanium, or a well-known material, such as resin or FRP plastic, or a combination of these substances.

The water receiving portion 33 in the present embodiment is a structure in which the heat insulating material for drain pans is disposed on the outer surface of the drain pan, and yet the present invention is not limited to this, and, for example, the drain pan itself may be made of a material that has thermal insulation.

(Operation)

The operation of the external-air conditioning apparatus 1 and the ventilation system V will be described with reference to FIG. 1 to FIG. 11. Hereinafter, a description will be separately given of a case in which those are run and a case in which those are subjected to maintenance.

<When Run>

Figure 11:
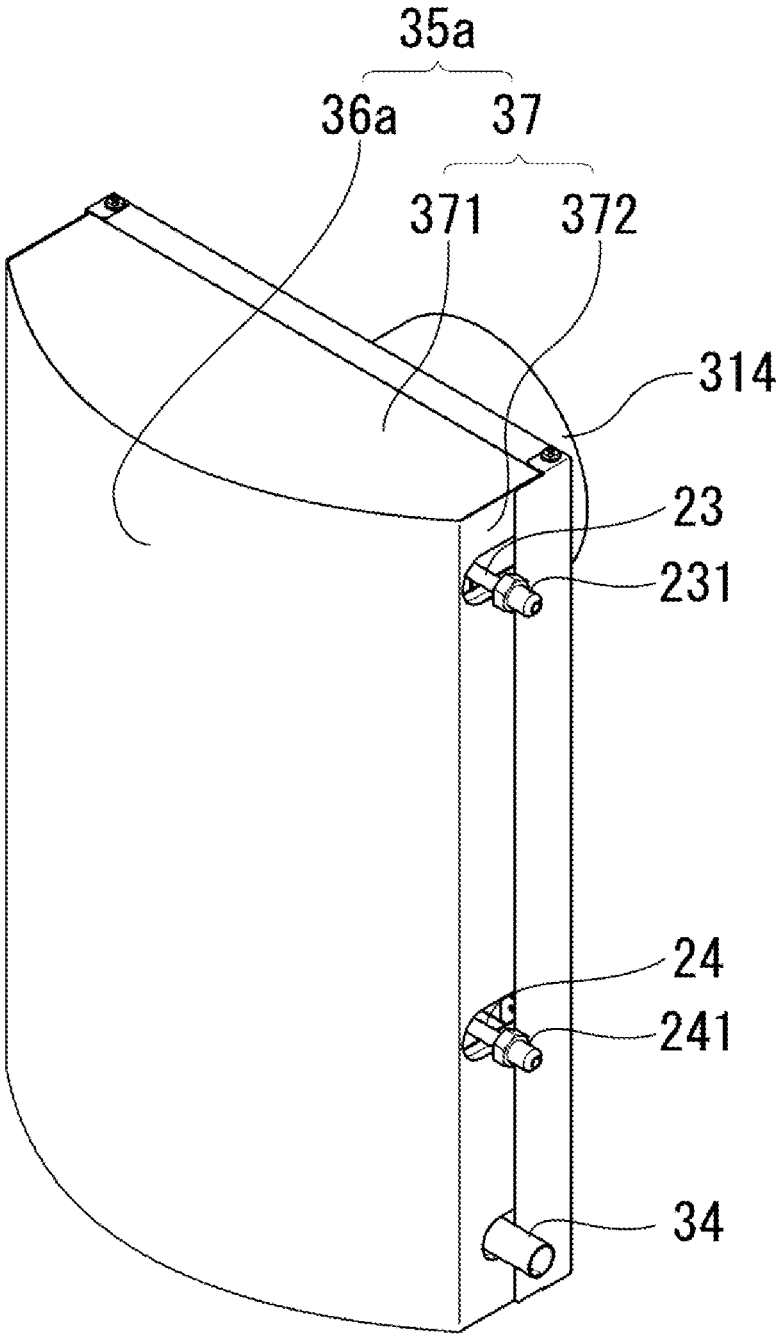
FIG. 11 is a perspective descriptive view showing Modification 1 that is a modification of the cover body.

As shown in FIG. 10 and FIG. 11, the inside of the room of the building is negative in pressure because of a ventilating fan W3 disposed at an exhaust port, and external air A1 is introduced into the external-air conditioning apparatus 1 through the inlet 38.

As shown in FIG. 9, the external air A1 that has been introduced into the external-air conditioning apparatus 1 strikes a bottom portion of the drain pan 336, and changes its flow direction, and flows toward the heat exchanger 2. At this time, the heat exchanger 2, the partitioning portion 25, and the base portion 31 are disposed according to the aforementioned configuration, and therefore the external air A1 introduced thereinto does not directly reach the outlet 313 without passing through the heat exchanger 2, i.e., substantially the whole amount of external air A1 introduced thereinto passes through the heat exchanger 2, and undergoes a heat exchange.

Additionally, the external air A1 introduced thereinto flows along the longitudinal direction of the fin 22, and therefore a period of time during which the external air A1 and the fin 22 make contact with each other becomes long, and therefore heat exchange efficiency is raised. Additionally, the outlet 313 is disposed so as to overlap with the range of the width of the heat exchanger 2, and therefore conditioned air A2 that has passed through the heat exchanger 2 and that has been conditioned smoothly flows toward the outlet 313. Still additionally, substantially the whole amount of conditioned air A2 that has passed through the heat exchanger 2 and that has been conditioned passes through the outlet 313 without diffusing in the housing 3 because of the partitioning portion 25, and is supplied into the room from the ventilating hole W1 through the introducing passage W2.

As a result, the amount of heat loss in the housing 3 decreases, and the amount of conditioned air A2 supplied into the room increases, and therefore it becomes possible to shorten a period of time during which a difference between the room temperature and the preset temperature of the room air conditioner becomes small, i.e., it becomes possible to shorten a period of time until the room temperature reaches the preset temperature (operating time of the room air conditioner 8), and therefore it is possible to further raise the effect of load reduction in the running of the room air conditioner 8 that performs room air conditioning.

Additionally, a heat exchange performed by the heat exchanger 2 uses a refrigerant supplied from the room air conditioner 8 that is installed outside the apparatus, and therefore the heat exchange performed by the heat exchanger 2 coordinates with the running of the room air conditioner 8, i.e., the heat exchanger 2 depends on the running of the room air conditioner 8 (uses the running of the room air conditioner 8), and does not need electric power or mechanical power other than power for room air conditioning.

By the way, the external-air conditioning apparatus 1 is installed outdoors, and therefore there is a case in which rain and snow enter through the inlet 38 in such a manner as to be caught in by a strong wind when it is stormy weather. Additionally, there is a case in which solar radiation light (ultraviolet) reflected by something enters through the inlet 38. However, even in these cases, it is possible to intercept ultraviolet or rain and snow so as not to strike the heat exchanger 2, i.e., it is possible to fulfill storm protection and a light intercepting function and to protect the deterioration of the heat exchanger because the external-air conditioning apparatus 1 is configured such that the water receiving portion 33 (drain pan 336) is disposed between the heat exchanger 2 and the inlet 38. Additionally, although external sounds, such as wind sound and noise, enter through the inlet 38, the water receiving portion 33 (drain pan 336) reflects sounds, or the heat insulating material 342 for drain pans that has been pasted onto the outer surface of the drain pan 336 absorbs sounds, and, as a result, external sounds are restrained from entering the room in the same way as above.

<When Subjected to Maintenance>

The external-air conditioning apparatus 1 is set on the wall surface W of the building, and therefore working, such as maintenance, can be started by detaching the cover body 35, and main components are disposed at the base portion 31, and therefore comparatively easy cleaning can be performed without detaching the base portion 31 from the wall surface W of the building. In other words, workability in maintenance, etc. has been made better than the conventional external-air conditioning apparatus 91 described above.

According to the external-air conditioning apparatus 1 and the ventilation system V, it is possible to more easily install the ventilation system of the present invention as a ventilation system for a new or already-existing ordinary house or housing complex than the conventional ventilation system, and it is possible to achieve excellent workability in maintenance, etc. and to realize energy saving by reducing the operation load of the room air conditioner installed in the room.

[Modification 1]

Figure 12:
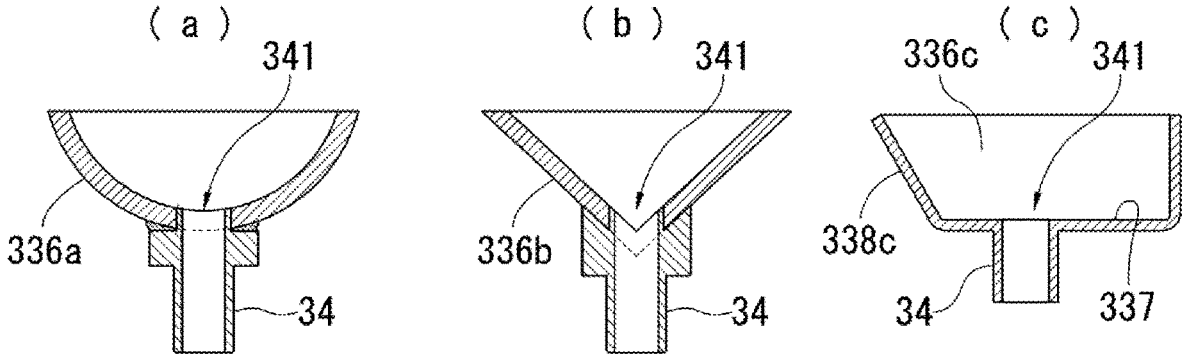
FIG. 12 shows a modification of a drain pan, (a) of which is a cross-sectional view of Modification 2, (b) of which is a cross-sectional view of Modification 3, and (c) of which is a cross-sectional view of Modification 4.

An external-air conditioning apparatus 1*a* shown in FIG. 12 is a modification of the external-air conditioning apparatus 1. The external-air conditioning apparatus 1*a* is the same as the external-air conditioning apparatus 1 except for a front wall portion 36*a* (described later), and therefore the same reference sign is given to a common component, and a description of its structure is omitted, and a description of a common operational effect is also omitted.

In the external-air conditioning apparatus 1*a*, the front wall portion 36*a* swells in a direction opposite to the base portion 31 (i.e., in a "frontal direction of the apparatus body"), and has a curved shape that is curved in the width direction of the apparatus body. The external-air conditioning apparatus 1*a* is formed in a shape that more easily diverts wind, rain, etc. than the external-air conditioning apparatus 1, thus making it possible to reduce a load applied onto the front wall portion.

[Modification 2]

Figure 13:
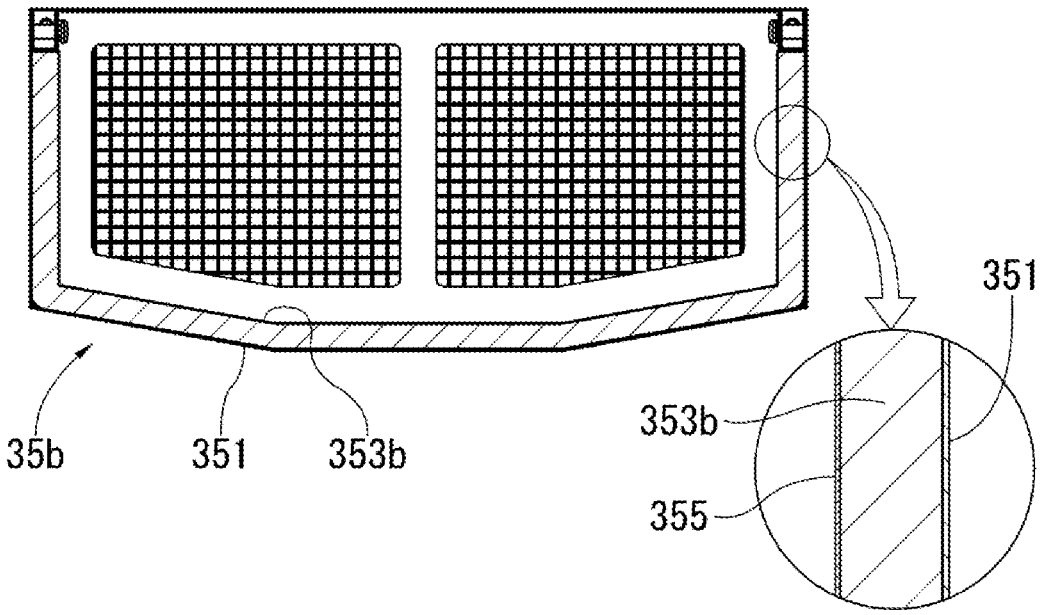
FIG. 13 is a partially-enlarged, cross-sectional descriptive view showing Modification 5 that is a modification of the cover body.

A drain pan 336*a* shown in FIG. 13(*a*) is a modification of the drain pan 336. The drain pan 336*a* is the same as the drain pan 336 except for a part described later, and therefore the same reference sign is given to a common component, and a description of its structure is omitted, and a description of a common operational effect is also omitted.

The drain pan 336*a* is formed in a semicircular shape in a cross-sectional view (i.e., long half-segmented circular tube shape) in which a bottom surface and lateral surfaces in the longitudinal direction (right and left sides in FIG. 13(*a*)) are formed integrally with each other, and the drain hole 341 leading to the drain passage 34 is formed in a lowest part corresponding to an inner bottom.

The drain pan 336*a* does not have a flat bottom surface portion, and therefore the obstruction of smooth airflow when external air is divided (occurrence of a turbulent flow) hardly occurs, and it is possible to further improve the efficient flow division of external air and the smooth flow of external air from the inlet to the heat exchanger. Additionally, the inner bottom surface of the drain pan 336*a* is not flat, and the drain hole 341 is formed in the lowest part, and therefore accumulated water in the drain pan 336*a* is discharged more efficiently.

[Modification 3]

A drain pan 336*b* shown in FIG. 13(*b*) is a modification of the drain pan 336. The drain pan 336*b* is the same as the drain pan 336 except fora part described later, and therefore the same reference sign is given to a common component, and a description of its structure is omitted, and a description of a common operational effect is also omitted.

The drain pan 336*b* is formed in a V shape in a cross-sectional view in which a bottom surface and lateral surfaces in the longitudinal direction (right and left sides in FIG. 13(*b*)) are formed integrally with each other, and the drain hole 341 leading to the drain passage 34 is formed in a lowest part corresponding to an inner bottom. The drain pan 336*b* does not have a flat bottom surface portion in the same way as the aforementioned drain pan 336*a*, and therefore it is possible to further improve the efficient flow division of external air and the smooth flow of external air from the inlet to the heat exchanger, and accumulated water in the drain pan 336*b* is discharged more efficiently.

[Modification 4]

A drain pan 336*c* shown in FIG. 13(*c*) is a modification of the drain pan 336. The drain pan 336*c* is the same as the drain pan 336 except for apart described later, and therefore the same reference sign is given to a common component, and a description of its structure is omitted, and a description of a common operational effect is also omitted.

The drain pan 336*c* is substantially identical in shape with the drain pan 336, but differs from the drain pan 336 in the fact that a lateral surface in a direction (left side in FIG. 13 (*c*)) disposed on the front side of the apparatus body is inclined toward the front side of the apparatus body. According to the configuration of the external-air conditioning apparatus 1, the partitioning portion 25 is provided, and therefore external air, which has struck the bottom surface of the drain pan and then has been divided and has come around in a direction of the body back of the drain pan (right side in FIG. 13(*c*)), reaches the heat exchanger 2 in such a way as to detour the partitioning portion. On the other hand, according to the drain pan 336*c*, only the lateral surface on the front side of the body is configured to be inclined, and the lateral surface on the back side of the body is configured to be along the base plate portion without making a gap with the base plate portion, and therefore external air that has struck the bottom surface 337 of the drain pan 336*c* flows toward the front side of the body, thus making it possible to further improve the smooth flow of external air from the inlet to the heat exchanger.

[Modification 5]

Figure 14:
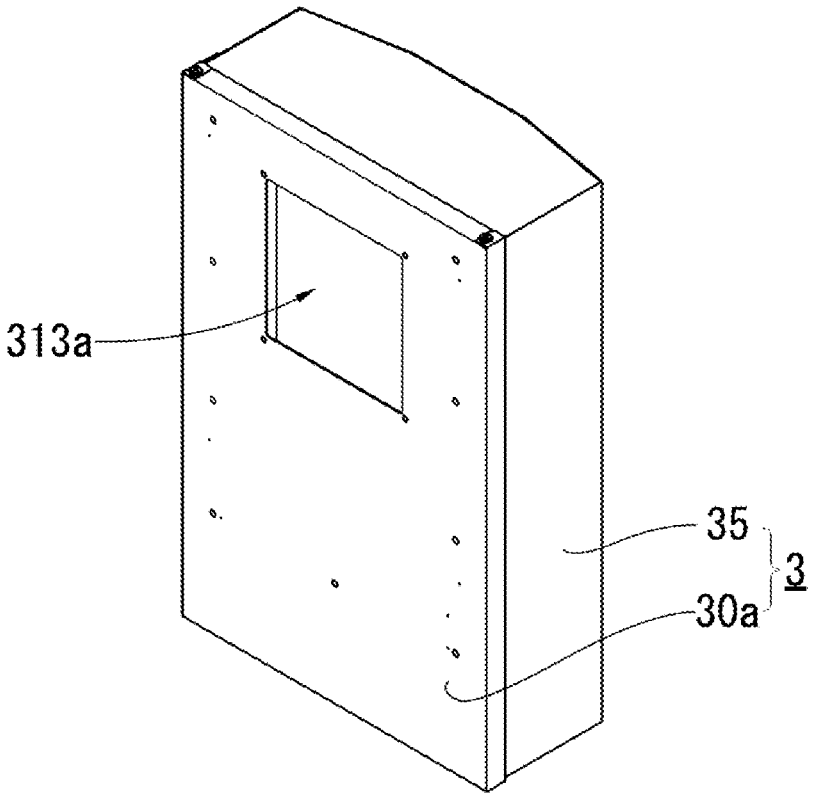
FIG. 14 is a perspective view of Modification 6 that is a modification of the base body, which is shown from the direction of the back.
Figure 15:
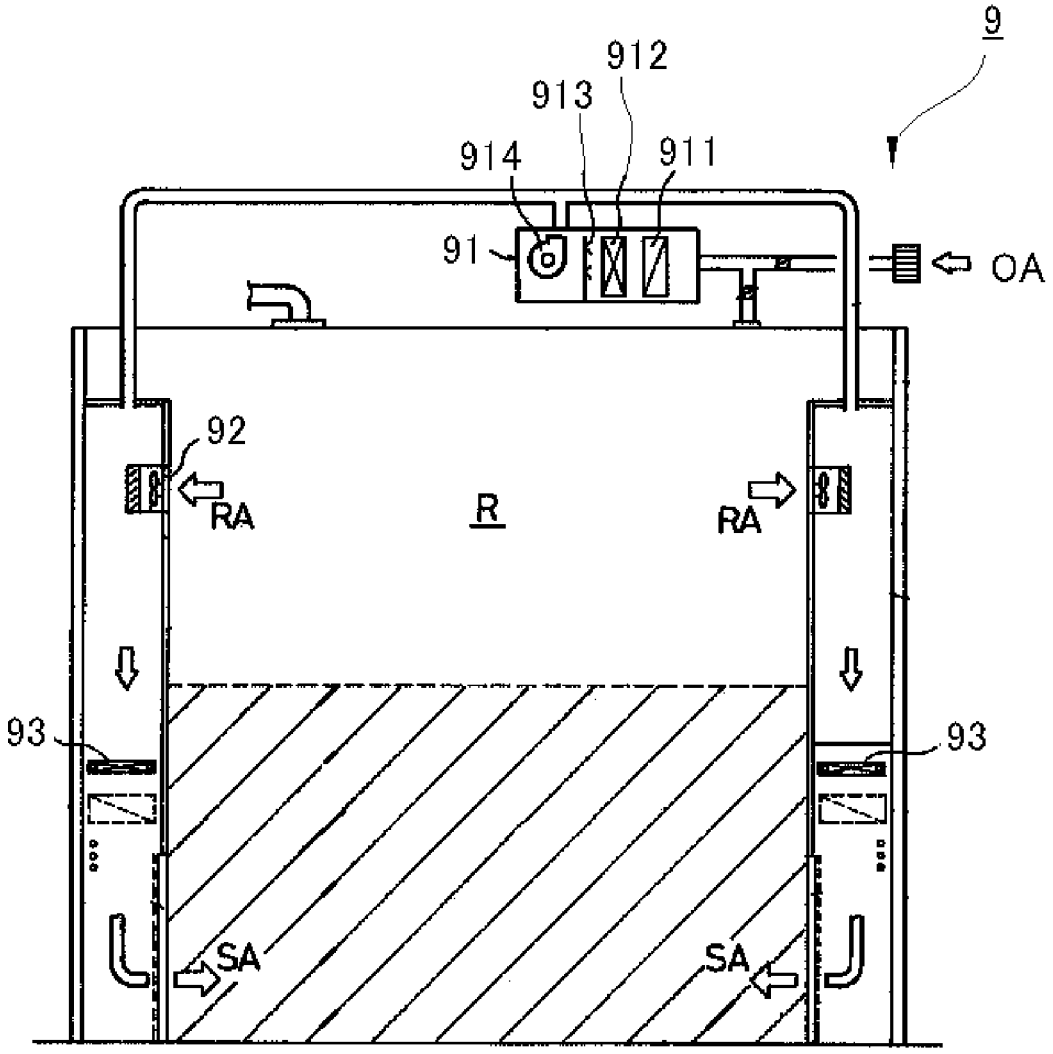
FIG. 15 is a schematic view of the air conditioning equipment mentioned in Patent Literature 1.

A cover body 35*b* shown in FIG. 14 is a modification of the cover body 35. In this modification, the same reference sign is given to a common component between the cover body 35*b* and the cover body 35, and a description of its structure is omitted, and a description of a common operational effect is also omitted.

The cover body 35*b* is a structure consisting of the outer surface plate 351 that serves as an outer surface of the apparatus body and a heat insulating material 353*b* that serves as an inner surface of the apparatus body (i.e., the inner surface plate and the thermal insulation region of the aforementioned cover body 35 are not provided). The heat insulating material 353*b* is formed in the shape of a sheet that has a heat-reflecting surface 355 made of aluminum foil that has rust resistance on its one side, and is stuck onto the apparatus-inside of the outer surface plate 351 with an adhesive so that the heat-reflecting surface 355 is directed to the inside of the apparatus body.

According to the cover body 35*b*, it is possible to allow the housing to have heat insulation properties by allowing the heat insulating material 353*b* to have the aforementioned heat-reflecting surface 355, and it is possible to restrain deterioration caused by, for example, the adhesion of dew drops generated inside the apparatus and the occurrence of mold on the front surface. Additionally, the cover body 35*b* is a simple, light structure formed merely by sticking the heat insulating material 353*b* onto the outer surface plate 351, and therefore it is possible to make the external-air conditioning apparatus 1 smaller in size and in weight and is possible to reduce production costs.

[Modification 6]

A base body 30*a* shown in FIG. 12 is a modification of the base body 30. The base body 30*a* is the same as that of the external-air conditioning apparatus 1 except for an outlet 313*a* (described later), and therefore the same reference sign is given to a common component, and a description of its structure is omitted, and a description of a common operational effect is also omitted.

The base body 30*a* differs from the base body 30 in the fact that a connecting pipe portion that leads to the outlet 313*a* on the back side of the apparatus body is not provided. According to the base body 30*a*, with excellent convenience, it is possible to simply perform an installation operation without a processing operation to the wall surface or without replacement of the external-air conditioning apparatus even if the outer diameter of the connecting pipe portion is larger than the inner diameter of the ventilating hole although it is impossible to fulfill the operational effect of raising the efficiency of a laying operation by fitting the connecting pipe portion to the ventilating hole and is impossible to fulfill the operational effect of reducing a load applied onto the wall surface on which the apparatus is set.

The terms and the expressions used in the present description and in the claims are used thoroughly descriptively, and are not limited-ones at all, and there is no intention of excluding characteristics mentioned in the present description and in the claims and no intention of excluding terms and expressions equivalent to part of the characteristics. Additionally, of course, various modifications can be made within the scope of the technical thought of the present invention. Still additionally, the terms "the first," "the second," etc. do not mean a grade or importance, and are used to distinguish one factor from other factors.

REFERENCE SIGNS LIST

1, 1*a*: External-air conditioning apparatus,
2: Heat exchanger
21: Heat-transfer pipe, 22: Fin, 23: First in-and-out pipe,
231: Joint portion, 24: Second in-and-out pipe, 241: Joint portion, 25: Partitioning portion, 251: Locking screw, 252: Drain hole, 260: End surface (lower surface) of heat exchanger,
3, 3*a*: Housing,
30, 30*a*: Base body,
31: Base portion, 311: Base plate portion, 312: Peripheral wall portion, 313, 313*a*: Outlet, 314: Connecting pipe portion, 315: Through-hole,
32: Heat-exchanger-holding structure portion, 321: Locking notch,
33: Water receiving portion, 331: Water-receiving support portion, 332: Side portion, 333: Bottom portion, 334: Upper portion, 335: Uprising part, 336, 336*a*, 336*b*, 336*c*: Drain pan, 337: Bottom surface, 338,338*c*: Lateral surface, 339: Opening portion,
34: Drain passage, 341: Drain hole, 342: Heat insulating material for drain pans,
35, 35*a*, 35*b*: Cover body, 351: Outer surface plate, 352: Inner surface plate, 353, 353*b*: Heat insulating material, 354: Thermal insulation region, 355: Heat-reflecting surface,
36, 36*a*: Front wall portion,
37: Peripheral wall portion, 371: Peripheral-wall upper surface portion, 372: Peripheral-wall right surface portion,
373: Peripheral-wall left surface portion,
38: Inlet, 381: Filter member,
W: Wall surface of building, W1: Ventilating hole, W2: Introducing passage, W3: Ventilating fan,
8: Room air conditioner, 81: Outdoor unit, 82: Indoor unit, 83: Refrigerant piping,
A1: External air, A2: Conditioned air, V: Ventilation system,

9: Air conditioning equipment, 91: External-air conditioning apparatus, 911: Cooling coil, 912: Heating coil, 913: Humidifier, 914: Blower, 92: Return air intake, 93: Sensible heat exchanger, OA: External air, RA: Air supplied into room, SA: Air that has undergone heat exchange, R: Room

The invention claimed is:

1. An external-air conditioning apparatus comprising: a heat exchanger that can be incorporated into a heat medium circuit of an air conditioning apparatus and including a heat transfer pipe and a plurality of fins; and a housing, wherein the housing comprises: a base portion in which the heat exchanger is stored and, the base portion having an outlet formed at a predetermined position; a front wall portion disposed opposite of the outlet of the base portion so that the front wall portion faces the base portion, wherein the front wall portion includes a first insulation structure portion; a peripheral wall portion disposed between the front wall portion and the base portion, wherein the peripheral wall portion includes a second insulation structure portion and an inlet capable of introducing external air being formed at a position distant from the outlet; a heat-exchanger-holding structure portion constructed to hold the heat exchanger in a longitudinal direction of one of the plurality of fins of the heat exchanger such that a direction from the inlet toward the outlet substantially coincide with each other and wherein the heat exchanger has predetermined intervals between the heat exchanger and an inner surface of the front wall portion, between the heat exchanger and an inner surface of the base portion, and between the heat exchanger and an inner surface of the peripheral wall portion; and a water receiving portion disposed between the heat exchanger and the inlet, wherein the water receiving portion comprises: a water-receiving support portion disposed at the base portion; a drain pan detachably supported by the water-receiving support portion; a drain passage capable of draining accumulated water that has been accumulated in the drain pan outwardly from the external-air conditioning apparatus; and a first heat insulating material disposed at an outer surface of the drain pan, and wherein the drain pan includes a top and a bottom wherein the top is open towards the heat exchanger and the top faces an open region, wherein the top of the drain pan is equal in width to or is larger in width than an end surface of the heat exchanger faced by the open region, wherein the drain pan is formed so as to gradually become smaller in width from the top of the drain pan to the bottom of the drain pan, wherein the plurality of fins of the heat exchanger is vertically disposed, wherein the water receiving portion is positioned directly below the heat exchanger to collect dew drops formed on and falling from the plurality of fins of the heat exchanger, wherein the water receiving portion is disposed above the inlet, allowing the external air entering the external-air conditioning apparatus through the inlet to pass between the water receiving portion and the front wall portion before flowing upward toward the heat exchanger, such that rain entering the inlet is prevented from directly striking the heat exchanger and instead hits the water receiving portion or the front wall portion.

2. The external-air conditioning apparatus according to claim 1, further comprising:

a frame-shaped partitioning portion disposed between the heat exchanger and the base portion such that the frame-shaped partitioning portion partitions a space between the heat exchanger and the base portion into an inner space and an outer space, wherein the outlet is positioned in a region within a frame of the frame-shaped partitioning portion, and wherein the region includes a space formed in the region, the space having a predetermined width.

3. The external-air conditioning apparatus according to claim 2, wherein the housing is divided into a base body and a cover body, wherein the base portion, the heat-exchanger-holding structure portion, and the water receiving portion are disposed in the base body, wherein the front wall portion, the peripheral wall portion, and each of the first and second insulation structure portions are disposed in the cover body, and wherein the base body and the cover body are configured to be attachable to and detachable from each other.

4. The external-air conditioning apparatus according to claim 3, wherein each of the front wall portion and the peripheral wall portion further includes an outer surface plate, an inner surface plate capable of reflecting heat disposed with a predetermined interval such that a void is formed between the outer surface plate and the inner surface plate, and a second heat insulating material disposed in the void such that a thermal insulation region is formed as a gap between the outer surface plate and the first heat insulating material.

5. The external-air conditioning apparatus according to claim 3, further comprising a cylindrical connecting pipe portion formed along a rim of the outlet on an outer surface of the base portion.

6. The external-air conditioning apparatus according to claim 3, wherein the housing has a filter member attached to cover at least the inlet.

7. The external-air conditioning apparatus according to claim 2, wherein the housing is formed such that the front wall portion swells in a direction opposite to the base portion.

8. A ventilation system comprising: an outer wall of a building including a ventilating hole formed therein and an introducing passage constructed to connect the ventilating hole and an indoor space together; and an external-air conditioning apparatus, wherein the external-air conditioning apparatus comprises: a heat exchanger incorporated into a heat medium circuit of an air conditioning apparatus and including a heat transfer pipe and a plurality of fins; and a housing, wherein the housing comprises: a base portion constructed to store the heat exchanger and to attach to the outer wall outside the building and having an outlet; a front wall portion disposed opposite of the outlet of the base portion so that the front wall portion faces the base portion, the front wall including a first insulation structure portion; a peripheral wall portion disposed between the front wall portion and the base portion, wherein the peripheral wall includes a second insulation structure portion and an inlet capable of introducing external air being formed at a position distant from the outlet; a heat-exchanger-holding structure portion constructed to hold the heat exchanger in a longitudinal direction of one of the plurality of fins of the heat exchanger such that a direction from the inlet toward the outlet substantially coincide with each other and wherein the heat exchanger has predetermined intervals between the heat exchanger and an inner surface of the front wall portion, between the heat exchanger and an inner surface of the base portion, and between the heat exchanger and an inner surface of the peripheral wall portion; and a water receiving portion disposed between the heat exchanger and the inlet, wherein the water receiving portion comprises: a water-receiving support portion disposed at the base portion; a drain pan detachably supported by the water-receiving support portion; a drain passage capable of draining accumulated water that has been accumulated in the drain pan outwardly from the external-air conditioning apparatus; and a first heat insulating material disposed at an outer surface of the drain pan, and wherein the drain pan includes a top and a bottom wherein the top is open towards the heat exchanger and the top faces an open region, wherein the top of the drain pan is equal in width to or is larger in width than an end surface of the heat exchanger faced by the open region, wherein the drain pan is formed so as to gradually become smaller in width from the top of the drain pan to the bottom of the drain pan, wherein the plurality of fins of the heat exchanger is vertically disposed, wherein the water receiving portion is positioned directly below the heat exchanger to collect dew drops formed on and falling from the plurality of fins of the heat exchanger, wherein the water receiving portion is disposed above the inlet, allowing the external air entering the external-air conditioning apparatus through the inlet to pass between the water receiving portion and the front wall portion before flowing upward toward the heat exchanger, such that rain entering the inlet is prevented from directly striking the heat exchanger and instead hits the water receiving portion or the front wall portion.

9. The ventilation system according to claim 8, further comprising:

a room air conditioner that has an indoor unit wherein the indoor unit performs air-conditioning of a room of the building;

an outdoor unit installed outside the building; and the heat medium circuit that is a connection piping, the connection piping constructed to connect together the outdoor unit and the indoor unit, wherein the room air conditioner interacts with the external-air conditioning apparatus.

10. The external-air conditioning apparatus according to claim 2, wherein the housing has a filter member attached to cover at least the inlet.

11. The external-air conditioning apparatus according to claim 2, further comprising a cylindrical connecting pipe portion formed along a rim of the outlet on an outer surface of the base portion.

12. The external-air conditioning apparatus according to claim 2, wherein each of the front wall portion and the peripheral wall portion further includes an outer surface plate, an inner surface plate capable of reflecting heat disposed with a predetermined interval such that a void is formed between the outer surface plate and the inner surface plate, and a second heat insulating material disposed in the void such that a thermal insulation region is formed as a gap between the outer surface plate and the first heat insulating material.

13. The external-air conditioning apparatus according to claim 1, wherein the housing is formed such that the front wall portion swells in a direction opposite to the base portion.

14. The external-air conditioning apparatus according to claim 1, wherein the housing has a filter member attached to cover at least the inlet.

15. The external-air conditioning apparatus according to claim 1, further comprising a cylindrical connecting pipe portion formed along a rim of the outlet on an outer surface of the base portion.

16. The external-air conditioning apparatus according to claim 1, wherein each of the front wall portion and the peripheral wall portion further includes an outer surface plate, an inner surface plate capable of reflecting heat disposed with a predetermined interval such that a void is formed between the outer surface plate and the inner surface plate, and a second heat insulating material disposed in the void such that a thermal insulation region is formed as a gap between the outer surface plate and the heat first insulating material.

17. The external-air conditioning apparatus according to claim 1, wherein the housing is divided into a base body and a cover body, wherein the base portion, the heat-exchanger-holding structure portion, and the water receiving portion are disposed in the base body, wherein the front wall portion, the peripheral wall portion, and each of the first and second insulation structure portions are disposed in the cover body, and wherein the base body and the cover body are configured to be attachable to and detachable from each other.

* * * * *